US010981398B2

(12) United States Patent
Tamaki

(10) Patent No.: US 10,981,398 B2
(45) Date of Patent: Apr. 20, 2021

(54) PRETREATMENT DEVICE

(71) Applicant: BROTHER KOGYO KABUSHIKI KAISHA, Nagoya (JP)

(72) Inventor: Shuichi Tamaki, Nagoya (JP)

(73) Assignee: BROTHER KOGYO KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 16/141,196

(22) Filed: Sep. 25, 2018

(65) Prior Publication Data

US 2019/0100033 A1 Apr. 4, 2019

(30) Foreign Application Priority Data

Sep. 29, 2017 (JP) ..... JP2017-192097

(51) Int. Cl.

| | |
|---|---|
| ***B41J 3/407*** | (2006.01) |
| ***B41J 11/00*** | (2006.01) |
| ***B41M 5/00*** | (2006.01) |
| ***D06C 15/10*** | (2006.01) |
| ***D06B 11/00*** | (2006.01) |
| ***B41J 11/06*** | (2006.01) |
| ***B41J 2/01*** | (2006.01) |

(52) U.S. Cl.

CPC ..... *B41J 11/002* (2013.01); *B41J 2/01* (2013.01); *B41J 3/4078* (2013.01); *B41J 11/00* (2013.01); *B41J 11/0055* (2013.01); *B41J 11/06* (2013.01); *B41M 5/0017* (2013.01); *D06B 11/0059* (2013.01); *D06C 15/10* (2013.01)

(58) Field of Classification Search

CPC ... B41J 11/002; B41J 11/00; B41J 2/01; B41J 11/06; B41J 11/0055; B41J 3/4078; D06B 11/0059; D06C 15/10; B41M 5/0017

See application file for complete search history.

(56) References Cited

U.S. PATENT DOCUMENTS

| | | | | |
|---|---|---|---|---|
| 6,189,989 | B1 | 2/2001 | Hirabayashi et al. | |
| 9,254,681 | B2 | 2/2016 | Sakai | |
| 2002/0028319 | A1* | 3/2002 | Hirabayashi | D06P 5/30 428/32.16 |
| 2005/0179708 | A1 | 8/2005 | Ben-Zur | |
| 2009/0244634 | A1 | 10/2009 | Hasegawa et al. | |
| 2010/0001099 | A1 | 1/2010 | Onda | |

(Continued)

FOREIGN PATENT DOCUMENTS

| | | |
|---|---|---|
| EP | 3121016 A1 | 1/2017 |
| JP | 2015-183339 A | 10/2015 |

OTHER PUBLICATIONS

New U.S. patent application claiming priority to JP Application No. 2017-192131 being filed concurrently on Sep. 25, 2018 (Client Reference Nos. 2017-00484US00/17223BRY21). (57 pages).

(Continued)

*Primary Examiner* — Yaovi M Ameh

(74) *Attorney, Agent, or Firm* — K&L Gates LLP

(57) ABSTRACT

A guide guides a movement of a platen from a set position P1 at which a recording medium is set on the platen to a press position P3 at which a heat press portion performs heat press operation on the recording medium. A distance from the set position P1 to the press position P3 is longer than a distance from the set position P1 to an application position P2 at which an application portion applies a pretreatment agent onto the recording medium set on the platen.

16 Claims, 18 Drawing Sheets

(56) References Cited

U.S. PATENT DOCUMENTS

| | | | | |
|---|---|---|---|---|
| 2014/0020189 | A1 | 1/2014 | Weibel et al. | |
| 2014/0192121 | A1* | 7/2014 | Bannai | B41J 2/2114 347/101 |
| 2015/0273866 | A1* | 10/2015 | Sakai | B41J 11/002 347/21 |
| 2015/0314615 | A1 | 11/2015 | Humet et al. | |
| 2017/0015113 | A1* | 1/2017 | Yamashita | D06B 11/00 |
| 2017/0334196 | A1 | 11/2017 | Petschik | |
| 2018/0207954 | A1* | 7/2018 | Schiestl | B41J 3/4078 |

OTHER PUBLICATIONS

Extended European Search Report issued in connection with related European Application No. 18195538.6, dated Mar. 4, 2019. (9 pages).

Non-Final Office Action issued in connection with U.S. Appl. No. 16/140,819, dated Dec. 16, 2019. (10 pages).

Final Office Action dated May 18, 2020 in corresponding U.S. Appl. No. 16/140,819.

Non-Final Office Action dated Feb. 22, 2021 in related matter U.S. Appl. No. 16/140,819.

* cited by examiner

FIG. 12A

T1

| POSITION | FIRST POSITION | SECOND POSITION |
|---|---|---|
| TEMPERATURE | FIRST TEMPERATURE | SECOND TEMPERATURE |
| TIME PERIOD | FIRST TIME PERIOD | SECOND TIME PERIOD |

FIG. 12B

T2

| | |
|---|---|
| OPERATION FLAG | 1 |
| TEMPERATURE | THIRD TEMPERATURE |
| TIME PERIOD | THIRD TIME PERIOD |

FIG. 12C

T2

| | |
|---|---|
| OPERATION FLAG | 0 |
| TEMPERATURE | FOURTH TEMPERATURE |
| TIME PERIOD | FOURTH TIME PERIOD |

PRETREATMENT DEVICE

CROSS-REFERENCE TO RELATED APPLICATION

This application claims priority to Japanese Patent Application No. 2017-192097 filed Sep. 29, 2017. The contents of the foregoing application are hereby incorporated herein by reference.

BACKGROUND

The present disclosure relates to a pretreatment device.

A recording device provided with an application portion that applies a pretreatment agent onto a cloth is known.

SUMMARY

However, the recording device does not have a device that dries the pretreatment agent applied to the cloth. If the pretreatment agent is not dried before performing printing, there is a possibility that image quality may deteriorate. In order to improve the image quality, it is preferable to provide a heat press device that dries the applied pretreatment agent and causes it to be fixed. In this case, since a press operation is performed and a part in contact with the pretreatment agent has heat, it is preferable for an operator to be distanced from the heat press device.

Embodiments of the broad principles derived herein provide a pretreatment device capable of allowing an operator to be distanced from a heat press portion, in the pretreatment device provided with the heat press portion.

The embodiments herein provide a pretreatment device of the present invention includes: a platen; an application portion that applies a pretreatment agent onto a recording medium set on the platen; a heat press portion that performs a heat press operation on the recording medium, to which the pretreatment agent has been applied by the application portion; and a guide that guides a movement of the platen from a set position at which the recording medium is set on the platen to a press position at which the heat press portion performs the heat press operation on the recording medium, a distance from the set position to the press position being longer than a distance from the set position to an application position at which the application portion applies the pretreatment agent onto the recording medium set on the platen.

BRIEF DESCRIPTION OF THE DRAWINGS

Embodiments will be described below in detail with reference to the accompanying drawings in which:

FIG. 12A shows a first table T1;

FIG. 12B is a diagram showing a second table T2;

FIG. 12C is a diagram showing the second table T2;

DETAILED DESCRIPTION

Figure 1:
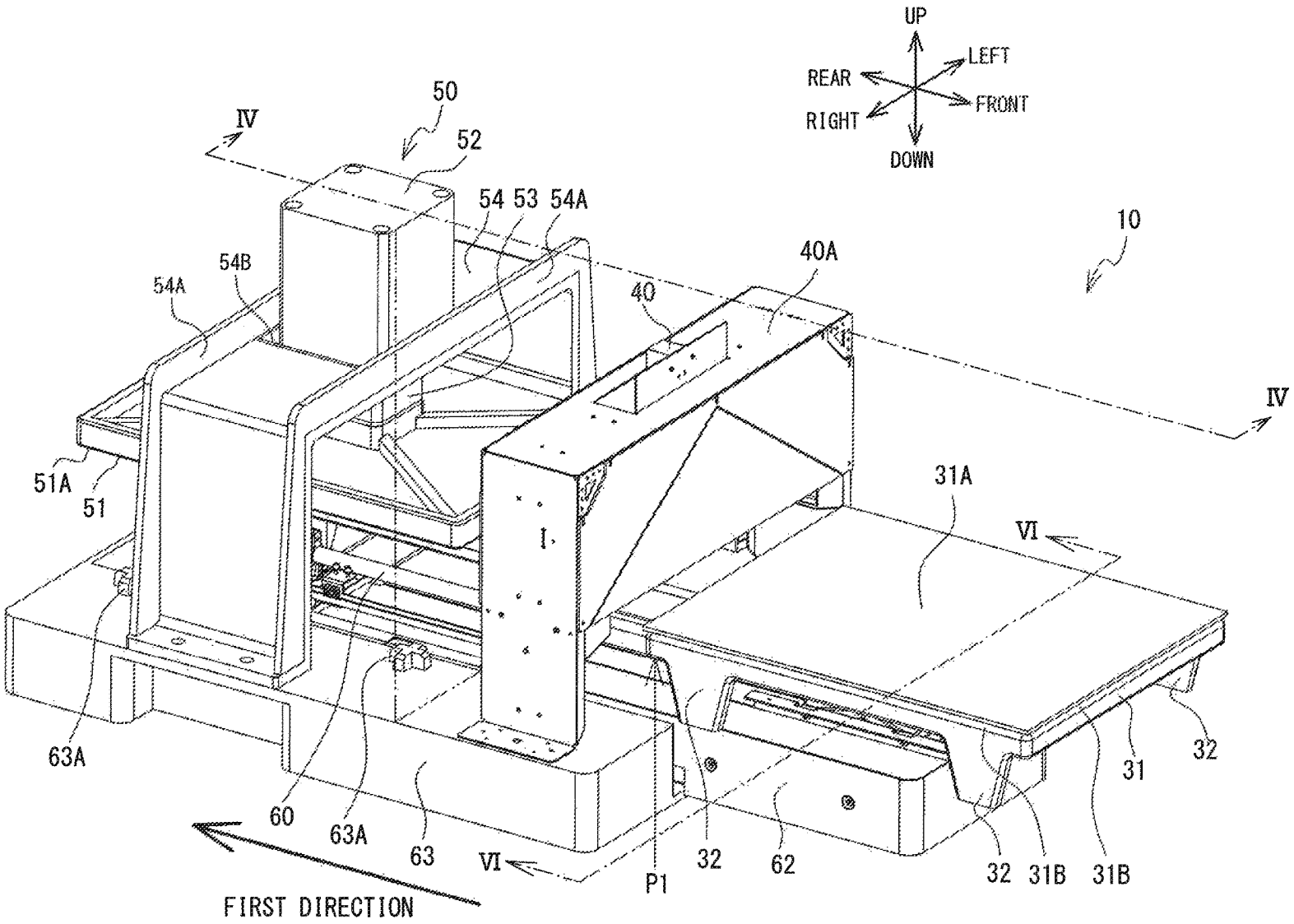
FIG. 1 is a perspective view showing an outline configuration of a pretreatment device 10.

A pretreatment device 10 of the present disclosure will be explained with reference to the drawings. A pretreatment device 10 of a present disclosure will be explained with reference to the drawings. An upper right side, a lower left side, a lower right side, an upper left side, a left side, and a right side in FIG. 1 are, respectively, a front side, a rear side, a right side, a left side, an upper side, and a lower side of the pretreatment device 10. The pretreatment device 10 is a device that performs pretreatment to apply a pretreatment agent, before print processing by an inkjet printer (not shown in the drawings) on a cloth that is an example of a recording medium. As a result of the pretreatment on the cloth, color development quality rises of color inks applied from the inkjet printer onto the cloth.

As shown in FIG. 1, the pretreatment device 10 is provided, in the direction from the front to the rear (hereinafter referred to as a "first direction") of the pretreatment device 10, with a platen 31 on which the cloth is placed, an application portion 40 that applies the pretreatment agent on the cloth, and a heat press portion 50 that dries the cloth to which the pretreatment agent has been applied. Examples of a material of the cloth include cotton, polyester, a cotton/polyester mix, and the like. The pretreatment agent improves the color development of color inks. Examples of the pretreatment agent include an aqueous solution that includes a metal salt of $CaCl_2$ or the like. By applying pressure to the cloth at a high temperature and drying the pretreatment agent, the heat press portion 50 improves fixing of the pretreatment agent on the cloth and improves image quality.

As shown in FIG. 1, the platen 31 disposed at a set position P1, the application portion 40, and the heat press portion 50 are arranged in order in the first direction of the pretreatment device 10. The set position P1 is a position at which the cloth is placed on the platen 31, and as an example, is a position at which the platen 31 has moved furthest to the front. Specifically, the heat press portion 50 is disposed in a position furthest from the set position P1 in the first direction. A press operation using a high temperature is referred to below as a "heat press operation." In addition to the configuration described below, the heat press may also be a pressure roller that presses the cloth using a high temperature roller.

The upper surface of the platen 31 is a substantially rectangular shape that is long in the first direction. A plate-shaped porous member 31A, which is substantially the same size as the upper surface of the platen 31, is placed on the upper surface of the platen 31. Examples of the porous member 31A include a sponge, a mesh material, steel wool, glass wool, rock wool, felt, and the like, and the porous member 31A is a member that internally contains many spaces. Since the porous member 31A internally contains the many spaces, the porous member 31A improves the release of steam resulting from moisture content included in the pretreatment agent at the time of the heat press operation. As shown in FIG. 2B, the platen 31 is provided, respectively, with plate-shaped leg portions 32 that protrude downward and that are long in the front-rear direction, at each of end portions on the two long sides of the lower surface of the platen 31. Each of the leg portions 32 is a substantially trapezoid shape that is tapered downward. Preferably, at least three of the leg portions 32 are provided, and four are provided in the present embodiment. The lower surface of each of the leg portions 32 is parallel to the upper surface of the platen 31. A length in the up-down direction of each of the leg portions 32 is the same.

Figure 2A:
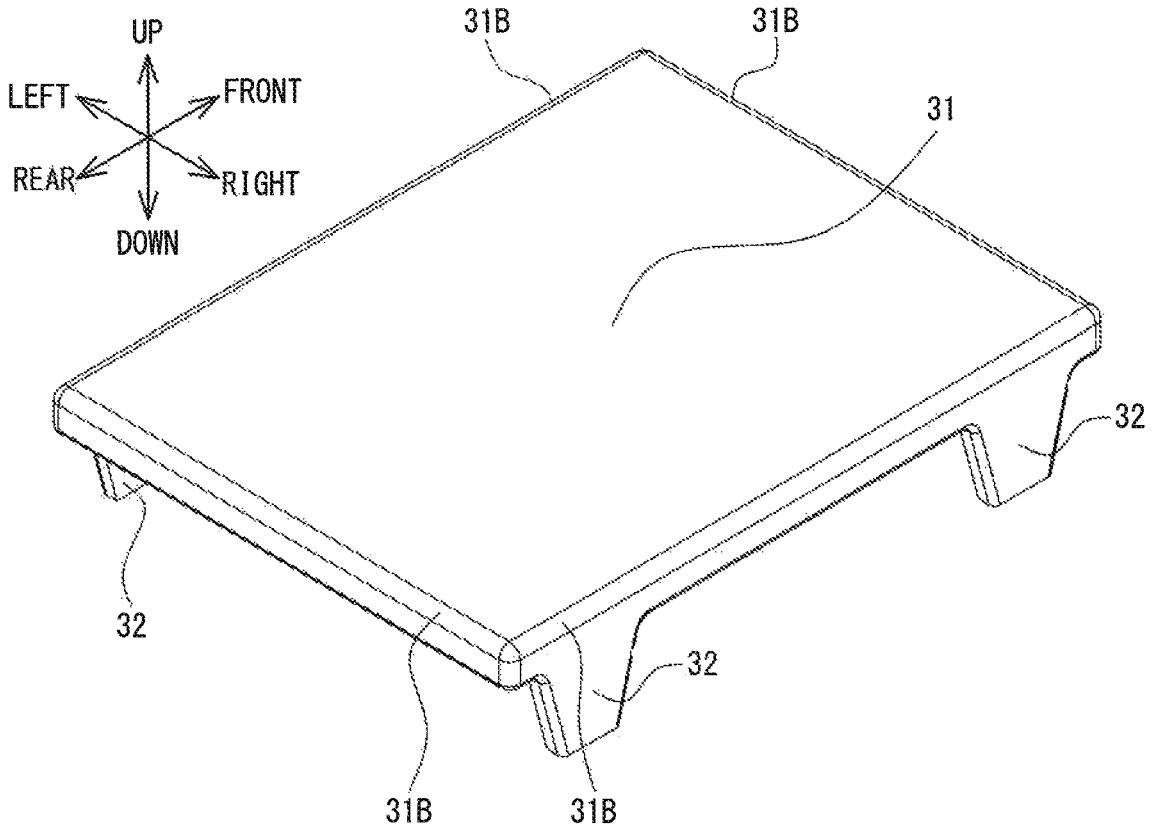
FIG. 2A is a perspective view of an upper surface of a platen 31.
Figure 2B:
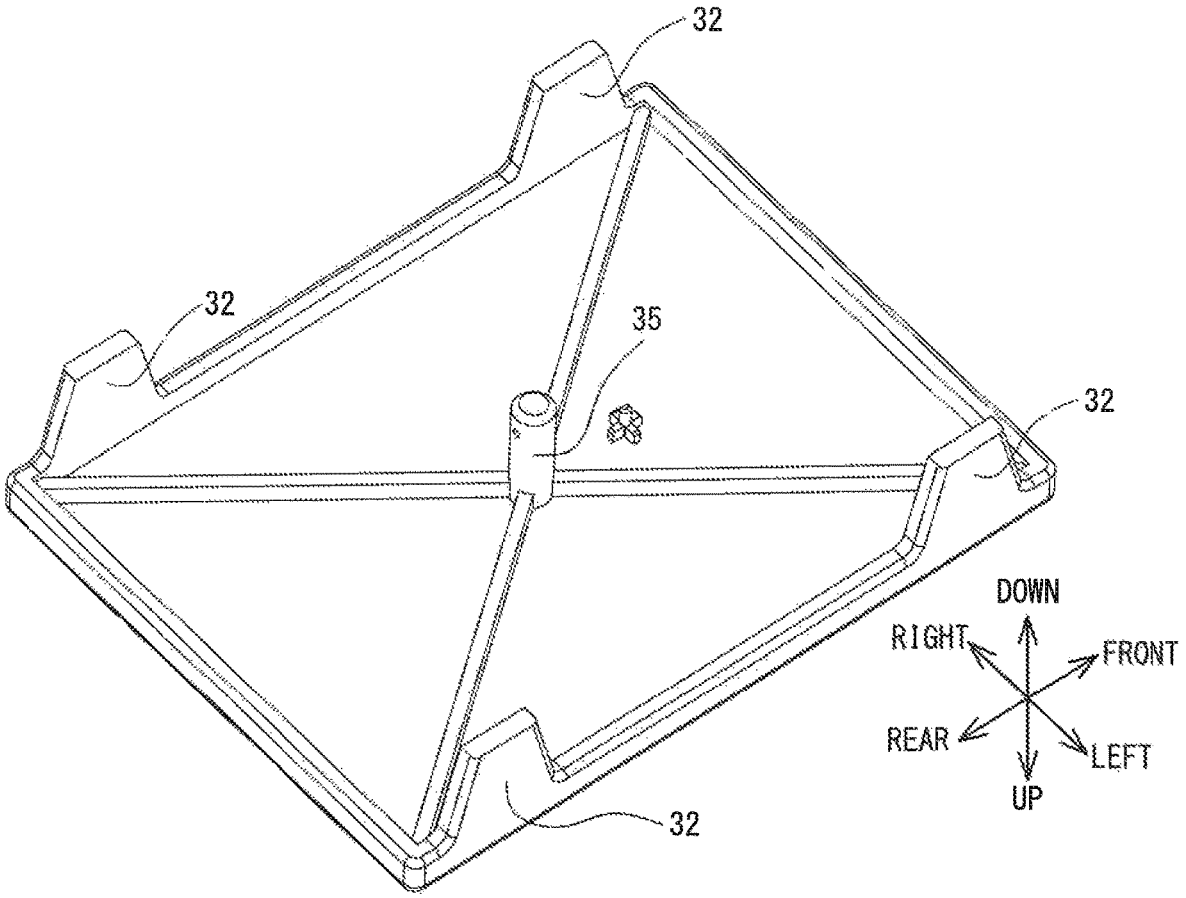
FIG. 2B is a perspective view of a back surface of the platen 31.
Figure 3:
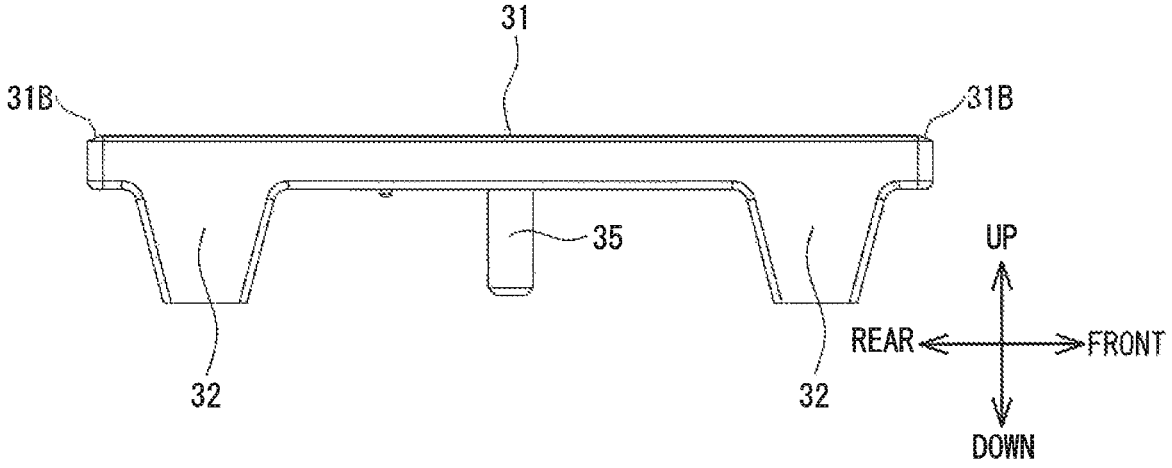
FIG. 3 is a side view of the platen 31 of a modified example.

As shown in FIG. 2A, each of end portions 31B in the front-rear direction and the left-right direction of the upper surface of the platen 31 are formed so as to be rounded downward (a curved surface). Note that, as shown in FIG. 3, each of the end portions 31B of the upper surface of the platen 31 may be formed so as to be a tapered portion that is inclined downward in a tapered shape. Further, some of the end portions 31 of the upper surface of the platen 31 may be formed in the downward rounded shape (the curved surface), and the other end portions 31B may be formed as the tapered portions. Further, at least one of the end portions 31B of the upper surface of the platen 31 may be formed in the downward rounded shape (the curved surface), and then formed as the downwardly inclined tapered portion from the lower end of the rounded shape.

Figure 4:
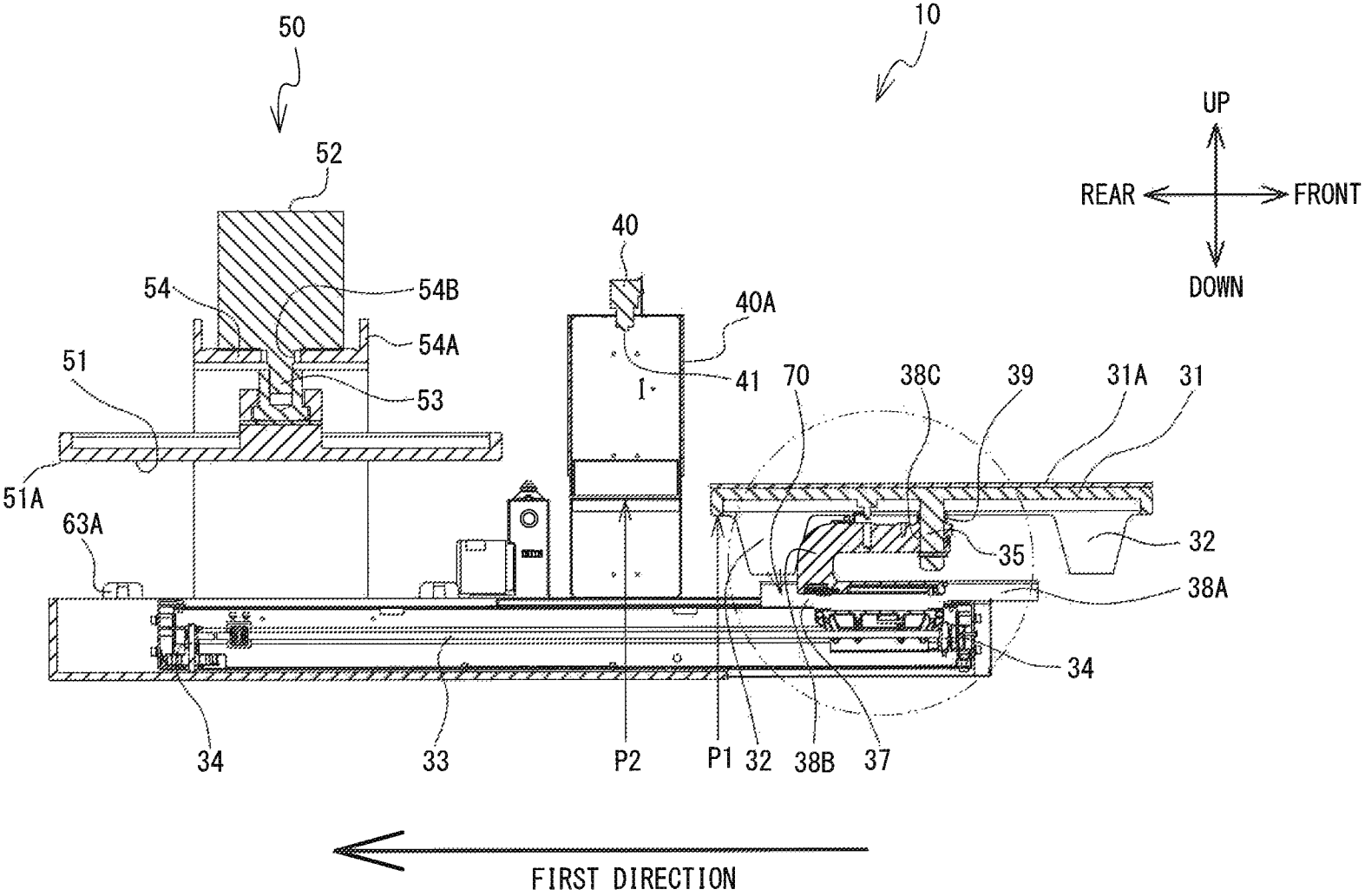
FIG. 4 is a cross-sectional view of the pretreatment device 10 along a line IV-IV shown in FIG. 1.

The pretreatment device 10 is provided, below the platen 31, with a platen conveyance mechanism 70 (refer to FIG. 7), which conveys the platen 31 in the front-rear direction. The platen conveyance mechanism 70 is provided extending in the first direction from the front portion of the pretreatment device 10, and is provided with two guides 60 (refer to FIG. 7) that are arranged so as to be aligned to the left and to the right. The guide 60 is a cylindrical metal rod, for example. The platen 31 moves in the front-rear direction along the two guides 60. As shown in FIG. 4, the platen conveyance mechanism 70 is provided with the two guides 60 (refer to FIG. 7), a belt 33, a pulley 34, a support portion 37, a platen motor 15 (refer to FIG. 10), and the like. The platen motor 15 is a stepping motor, for example. As shown in FIG. 2B, a cylindrically shaped coupling portion 35 is provided in a central portion of the lower surface of the platen 31.

Figure 5:
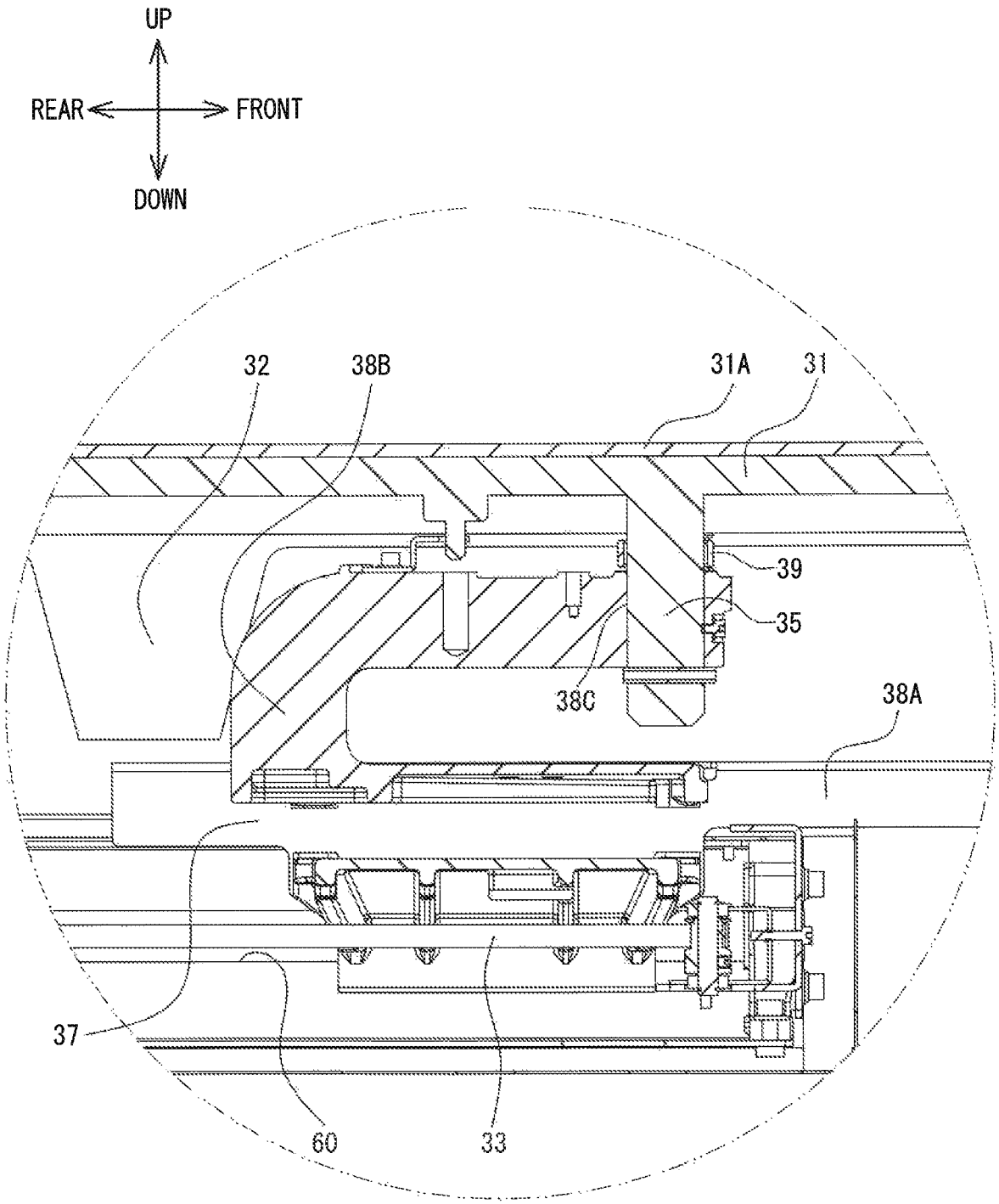
FIG. 5 is an enlarged view of a part surrounded by a circle of a double-dashed line shown in FIG. 4.
Figure 7:
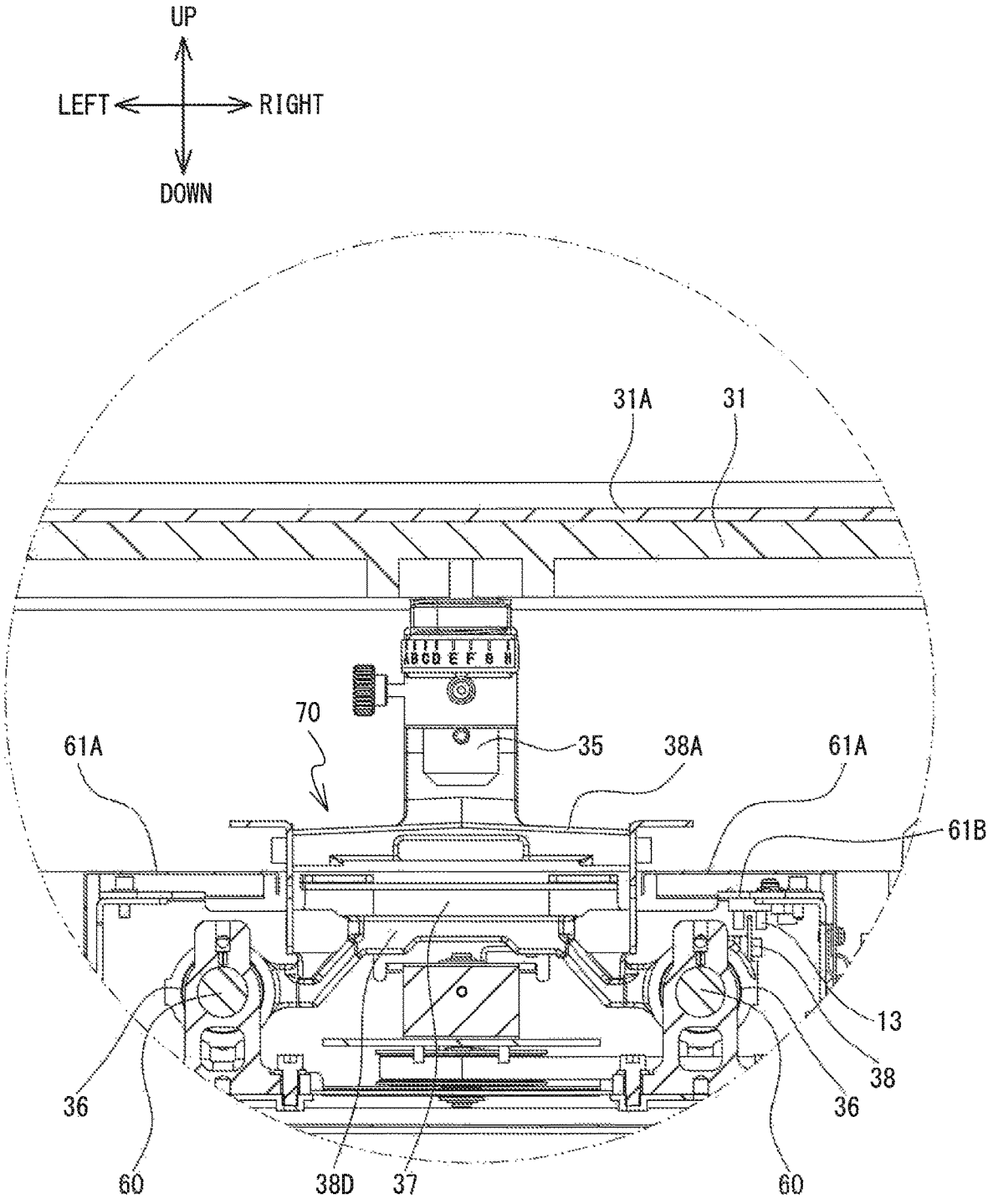
FIG. 7 is an enlarged view of a part surrounded by a circle of a double-dashed line shown in FIG. 6.

As shown in FIG. 5 and FIG. 7, the support portion 37 supports the platen 31. In addition to insertion holes 36, the support portion 37 is provided with a flap 38 that is provided extending upward from the vicinity of one of the insertion holes 36 of the support portion 37, a table 38A, a table support portion 38D, an arm portion 38B, and the like. More specifically, the table 38A is disposed between a first base 62 that will be described later and the platen 31, and is a plate-shaped member that is long in the first direction. The table support portion 38D supports the table 38A from below, a lower portion of the table support portion 38D is formed so as to bifurcate in the left-right direction, and the insertion holes 36 are formed in each of the end portions of the bifurcated lower portion. The arm portion 38B extends upward from the table 38A, curves toward the front, and extends in parallel to the lower surface of the platen 31. The leading end of the arm portion 38B has a cylindrical through hole 38C so as to penetrate the leading end of the arm portion 38B in the up-down direction. The coupling portion 35 of the platen 31 is coupled to the support portion 37 that is inserted through the through hole 38C. As shown in FIG. 7, the support portion 37 has the two insertion holes 36 through which the two guides 60 are inserted. The platen 31 is supported by the platen conveyance mechanism 70 by the coupling portion 35 being coupled to the support portion 37. Thus, the platen 31 moves in the front-rear direction in accordance with the movement of the support portion 37 in the front-rear direction by the belt 33 of the platen conveyance mechanism 70.

Figure 6:
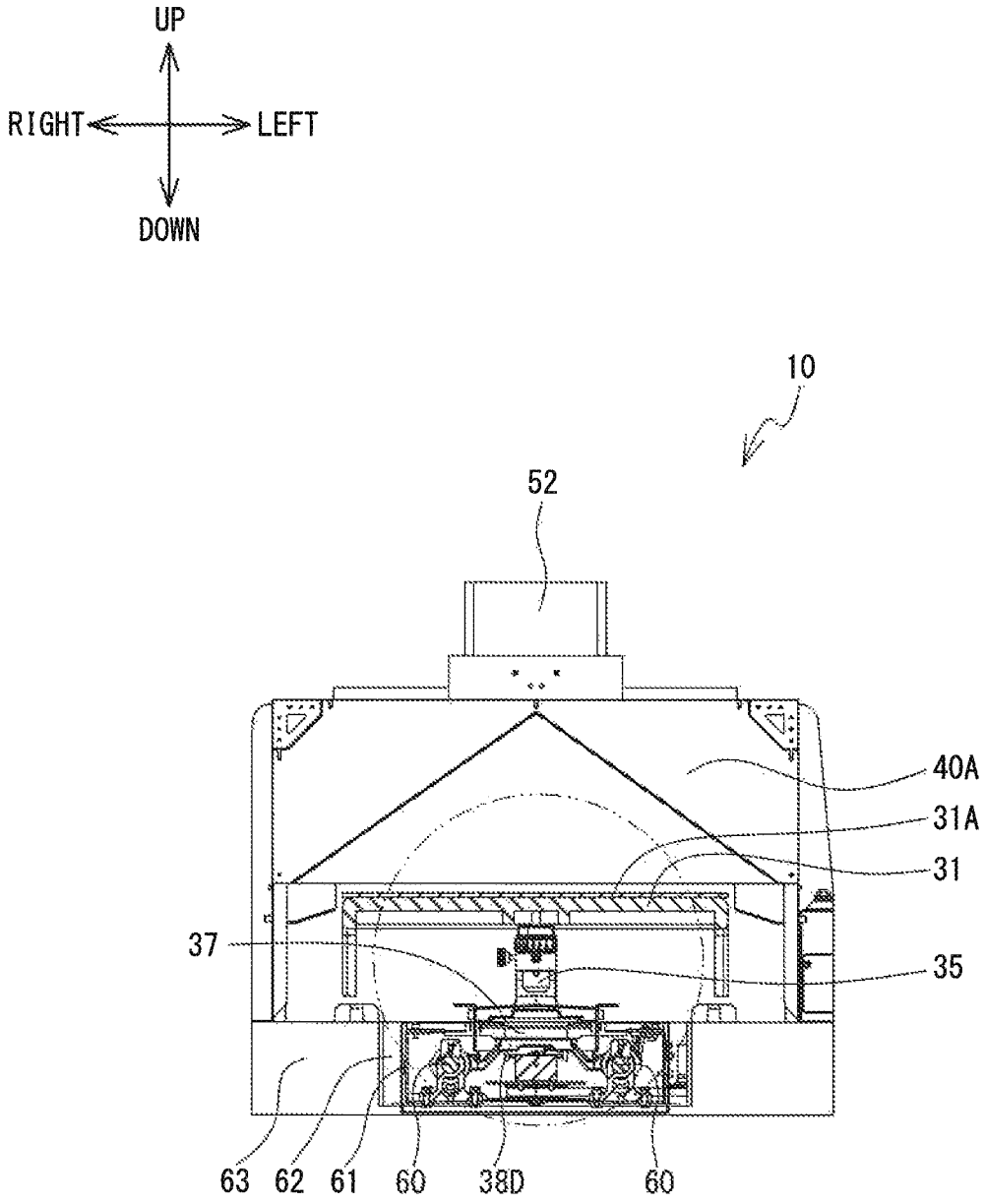
FIG. 6 is a cross-sectional view of the pretreatment device 10 along a line VI-VI shown in FIG. 1.

As shown in FIG. 6, the pretreatment device 10 is provided with the first base 62, which has a recessed portion 61 that is recessed in the first direction in a central portion in the left-right direction of the first base 62. The first base 62 is formed as a cuboid body that is long in the first direction. As shown in FIG. 6, the platen conveyance mechanism 70 that includes the two guides 60 is housed in the recessed portion 61 of the first base 62. As shown in FIG. 7, the left and right sides of the upper surface of the recessed portion 61 are covered by rectangular shaped top plates 61A that are long in the first direction. In other words, the central portion of the recessed portion in the left-right direction is open in the front-rear direction such that the platen conveyance mechanism 70 can move. Thus, since the left and right sides of the upper surface of the recessed portion 61 are covered by the top plates 61A, the pretreatment device 10 can reduce the risk of the pretreatment agent infiltrating into the recessed portion 61 housing the platen conveyance mechanism 70. The pretreatment device 10 is provided with a second base 63, which is formed in a cuboid shape that is long in the first direction, on the outside of the first base 62 in the left-right direction.

As shown in FIG. 5, in the platen 31, an urging member 39 that urges the platen 31 upward is provided on an upper portion of the coupling portion 35. The urging member 39 is an elastic member, and is a coil spring, for example. The upper end portion of the urging member 39 is in contact with the lower surface of the platen 31 and the lower end portion is in contact with the upper portion of the support portion 37, thus urging the platen 31 upward. It is sufficient that the urging member 39 have a shape into which the coupling portion 35 can be inserted, and, as an example, may be a cylindrical shape having a hole into which the coupling portion 35 is inserted. In other words, the platen 31 is urged upward by the urging member 39, but the platen 31 can be moved in the downward direction as the result of a downward pressing force. Further, when the downward pressing force is released, the platen 31 moves upward.

Configuration of Application Portion 40

As shown in FIG. 1, the application portion 40 is disposed so as to be separated from the set position P1 in the first direction. The application portion 40 is provided with a nozzle drive mechanism (not shown in the drawings), at least one spray 41 (refer to FIG. 4), a tank (not shown in the drawings) for the pretreatment agent, a flow path (not shown in the drawings) to supply the pretreatment agent inside the tank to the spray 41, and the like. The nozzle drive mechanism is provided with a pulley (not shown in the drawings), and, a spray motor 17 (refer to FIG. 10), and the like. A spraying surface of the spray 41 faces the upper surface of the platen 31. The spray 41 can be moved in the up-down direction by the nozzle drive mechanism. When a detector 24 to be described later detects the movement of the platen 31 to an application position P2 (refer to FIG. 4), the spray 41 starts to spray the pretreatment agent onto the cloth. The application position P2 is a position at which the application portion 40 starts to apply the pretreatment agent. Nozzles (not shown in the drawings) of the spray 41 are respectively connected to the flow paths supplying the pretreatment agent inside the tank to the spray 41.

The spray 41 of the application portion 40 is surrounded by side surfaces to the left and the right, side surfaces to the front and the rear, and an upper surface of a second cover 40A that is provided extending vertically from the left end portion and the right end portion of the second base 63. The side surfaces to the left and the right are formed by plate-shaped members that are long in the up-down direction. The side surfaces to the front and the rear and the upper surface are formed by plate-shaped members that are long in the left-right direction. A surrounding structure provided with the left and right side surfaces, the front and rear side surfaces, and the upper surface that surround the application portion 40 is referred to as the "second cover 40A." The application portion 40 is provided in a central portion of the upper surface of the second cover 40A. When the cloth and the porous member 31A are placed on the platen 31, the position in the up-down direction of the front and rear side surfaces is set to be a location at which the cloth can pass below the lower edges of the front and rear side surfaces.

For example, when an operator instructs to change the position in the up-down direction of the spray 41, via an operation portion 20 to be described later (refer to FIG. 10) or a communication portion 23, the spray 41 is moved by the nozzle drive mechanism to a position specified by the operator. In this case, a CPU 11 (an spray control portion) to be described later refers to a correlation relationship between a distance, which is stored in a storage portion 12 to be described later, between the spraying surface of the spray 41 and an application surface of the cloth, and a spraying amount of the pretreatment agent from the spray 41, and performs control such that a spraying amount per unit area at a position (a first position) of the spray 41 at a normal time, and a spraying amount per unit area at a position (a second position) of the spray 41 that has moved further downward from the first position are substantially the same. Further, as shown in FIG. 11, when the application portion 40 has a plurality of the sprays 41, for example, when the operator specifies the spray 41 to be stopped, via the operation portion 20 or the communication portion 23, the specified spray 41 stops the spraying of the pretreatment agent. When there is the plurality of sprays 41, the sprays 41 are arranged side by side in the left-right direction.

Configuration of Heat Press Portion 50

As described above, the heat press portion 50 is disposed so as to be separated from the application portion 40 in the first direction. As shown in FIG. 1, the heat press portion 50 is provided with a press surface 51, a press surface drive mechanism 52, a coupling portion 53, a press support portion 54, and the like. The press surface drive mechanism 52 is provided with a pulley (not shown in the drawings), a press motor 19, and the like. As shown in FIG. 1, the press surface 51 is formed in a substantially rectangular shape that is long in the first direction. Further, an end portion 51A of the press surface 51 is preferably formed as a curved surface or as a tapered portion having a tapered shape that is inclined upward. The press surface 51 is internally provided with a heat generation mechanism (not shown in the drawings) that generates heat to a specified temperature, and can be moved up and down by the press surface drive mechanism 52. When the detector 24 detects the movement of the platen 31 to a press position P3 (refer to FIG. 8), the press surface 51 is lowered by the press surface drive mechanism 52, and the press surface 51 starts the heat press operation on the cloth. When the detector 24 detects the movement of the platen 31 to the press position P3, the operation by which the press surface drive mechanism 52 lowers the press surface 51, and the press surface 51 starts to heat press the cloth is referred to as an "operation mode." In the "operation mode," for example, the press surface 51 is lowered by the press surface drive mechanism 52 only when the detector 24 detects the movement of the platen 31 to the press position P3. The press position P3 is a position at which the heat press portion 50 starts the press operation. The direction in which the press surface 51 is lowered is a press direction. The press surface 51 is larger in all directions (the front-rear direction) than the press surface 51. Therefore, when the platen 31 is positioned at the press position P3, the pretreatment device 10 can heat press a region of the cloth, to which the pretreatment agent has been applied, in one operation A position of the lower surface of the press surface 51 at a standby position at the time when the heat press of the press surface 51 is not performed is set so as to be higher than a position of the upper surface of the cloth when the porous member 31A and the cloth are placed on the upper surface of the platen 31. The coupling portion 53 extends perpendicularly and downwardly from a central portion of the lower surface of the press surface drive mechanism 52 toward the upper surface of the press surface 51, and couples the press surface 51 with the press surface drive mechanism 52.

As shown in FIG. 1, the press support portion 54 is vertically provided from both the left end portion and the right end portion of the second base 63, and has a shape formed as a result of plate-shaped side surfaces parallel to the first direction and a plate-shaped upper surface parallel to the upper surface of the platen 31 being coupled together. Front and rear end portions of the press support portion 54 are provided with flanges 54A that respectively extend vertically and outwardly with respect to the both side surfaces and the upper surface of the press support portion 54. By providing the flanges 54A, the pretreatment device 10 can improve the strength of the press support portion 54. The press support portion 54 includes a substantially square-shaped through-hole 54B in a central section of the upper surface of the press support portion 54. The shape of the through-hole 54B is substantially the same as the cross-sectional shape of the coupling portion 53 when the coupling portion 53 is cut in a direction parallel to the upper surface of the platen 31. As shown in FIG. 4, the size of the through-hole 54B is smaller than the size of the lower surface of the press surface drive mechanism 52, and is a size that allows the coupling portion 53 to be inserted through the through-hole 54B. Thus, by inserting the coupling portion 53 into the through-hole 54B and coupling the press surface 51 with the coupling portion 53, the press support portion 54 supports the press surface 51. Note that, when the platen 31 is at the press position P3, the press surface 51 may be smaller than the platen 31 in all directions.

Mechanism to Allow Press Pressure to Escape

Figure 8:
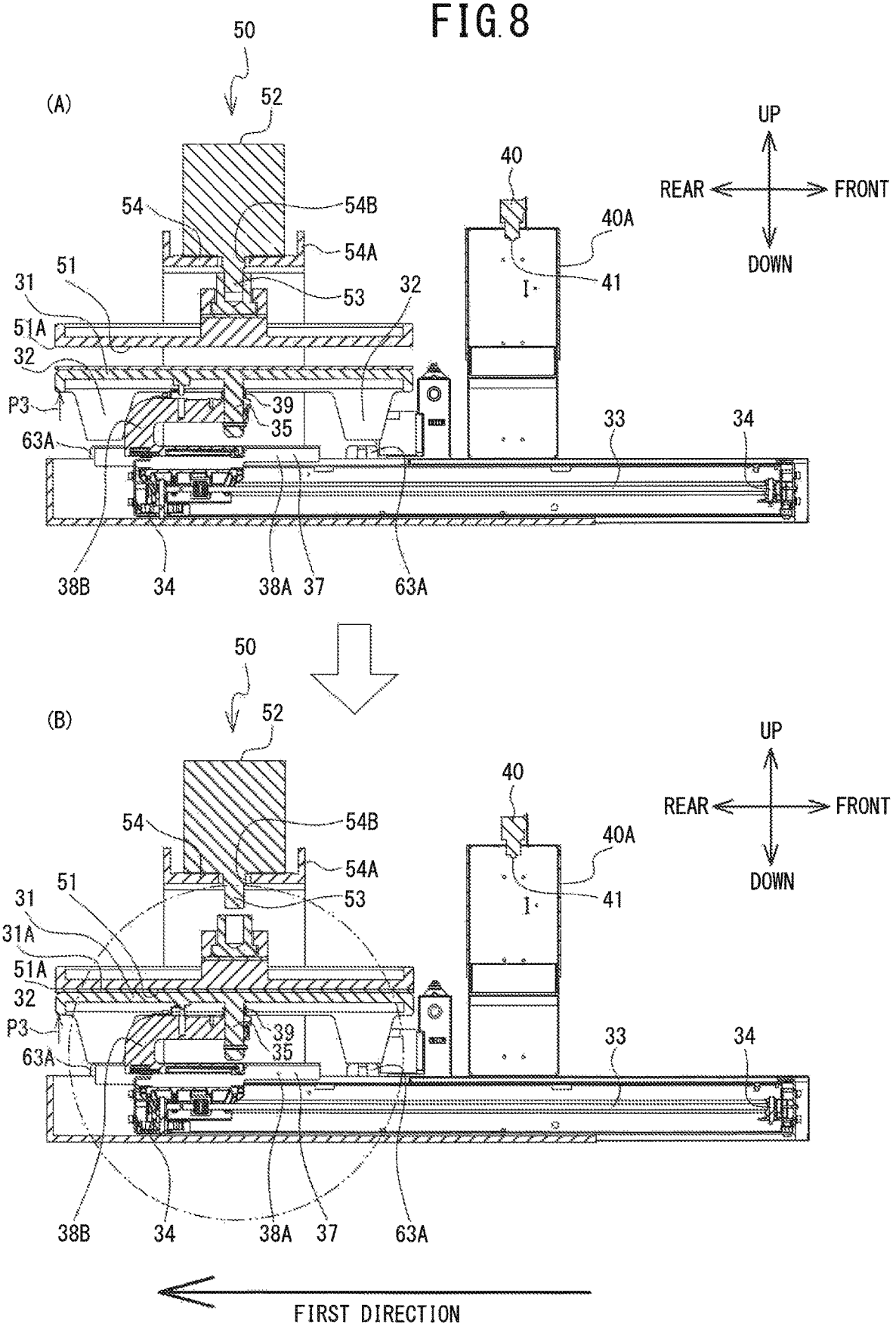
FIG. 8 is a cross-sectional view of the pretreatment device 10 along the line IV-IV shown in FIG. 1 immediately before a heat press operation and at a time of the heat press operation.
Figure 9:
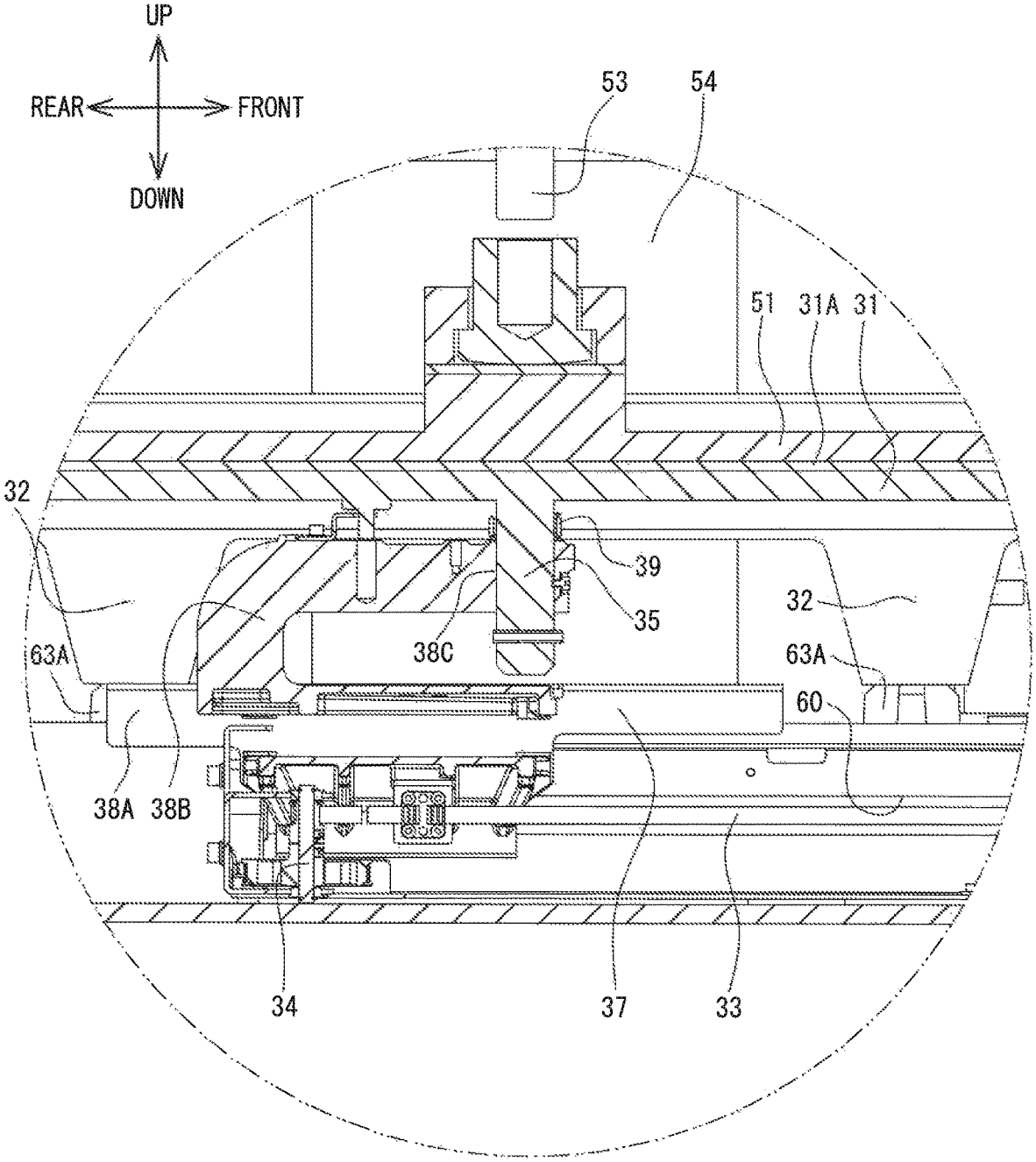
FIG. 9 is an enlarged view of a part surrounded by a circle of a double-dashed line shown in FIG. 8.

A mechanism to allow press pressure to escape will be explained with reference to FIG. 8 and FIG. 9. In FIG. 8, FIG. 8A shows a state immediately before the heat press operation after the platen 31 has arrived at the press position P3, and FIG. 8B shows a state at a time of the heat press operation. FIG. 9 is an enlarged view of a part surrounded by a circle of a double-dashed line in FIG. 8. As described above, the platen 31 is provided with four of the leg portions 32 on the lower surface thereof. Further, the second base 63 on the left and the right side is provided with four contact portions 63A at positions, of the upper surface of the second base 63, which face positions of the leg portions 32 at the time of the heat press operation. A total length of the height of the contact portion 63A and the length of the leg portion 32 in the up-down direction is set in advance such that the total length does not exceed a movement limit of the platen 31 in the downward direction when each of the leg portions 32 comes into contact with each of the contact portions 63A at the time of the heat press operation. Movement limits are an upper limit and a lower limit of the movable range of the platen 31 in the up-down direction. More specifically, as shown in FIG. 8B, at the time of the heat press operation, the platen 31 is moved in the downward direction within a range that does not exceed the movement limit, and is supported by each of the leg portions 32 and each of the contact portions 63A. Further, as shown in FIG. 9, a lower end of the coupling portion 35 of the platen 31 is set in advance so as not to be able to come into contact with the support portion 37 coupled with the guides 60, when the leg portions 32 respectively face and come into contact with the contact portions 63A at the time of the heat press operation. Thus, press pressure is allowed to escape from each of the leg portions 32 to each of the contact portions 63A. As a result, the press pressure applied to the guides 60 can be reduced. Therefore, compared with the pretreatment device 10 that does not include the contact portions 63A and the leg portions 32, as there is no need to increase the rigidity of the guides 60, the pretreatment device 10 of the present embodiment can achieve both cost reductions or downsizing.

Electrical Configuration of Pretreatment Device 10

Figure 10:
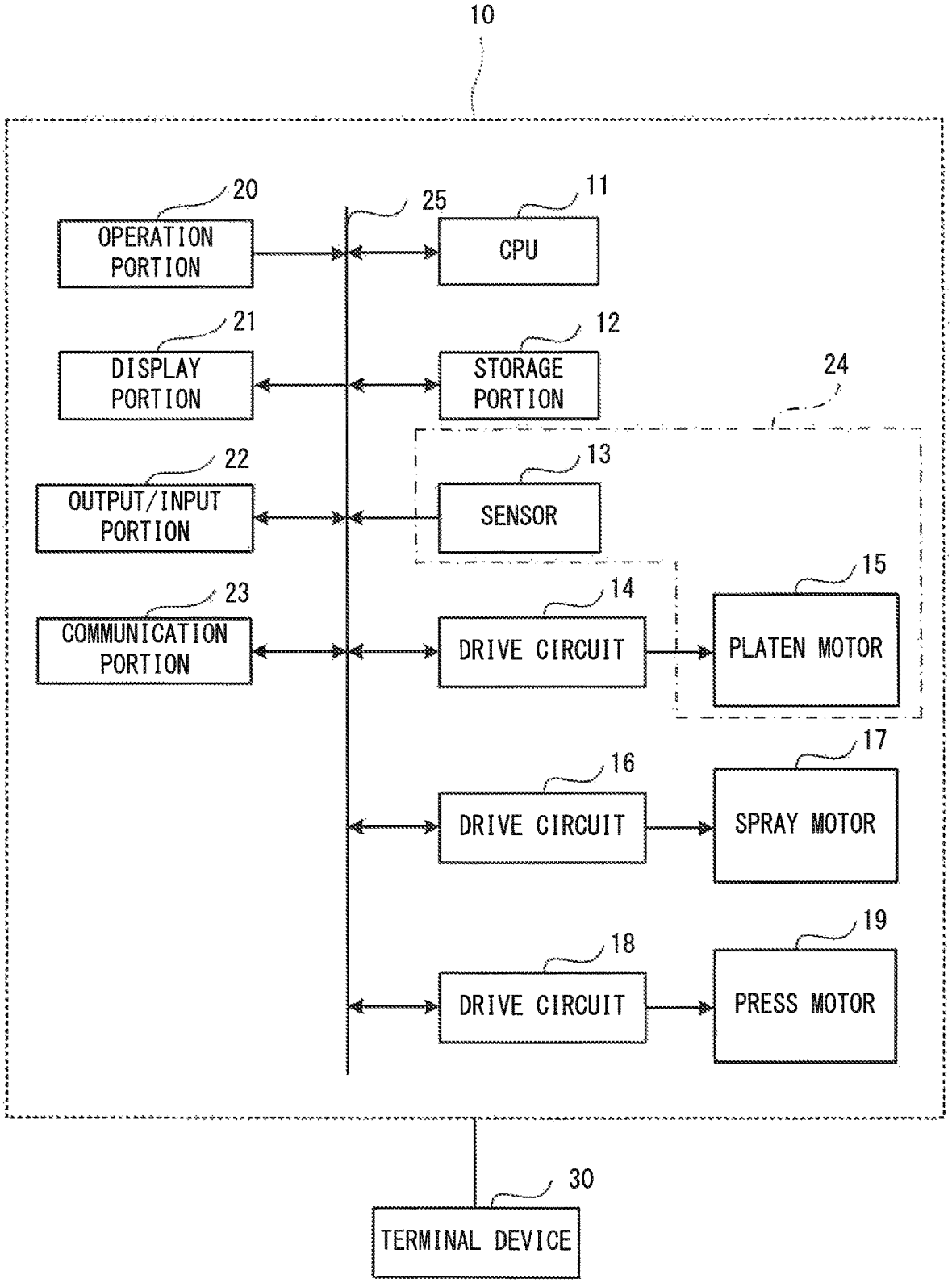
FIG. 10 is a block diagram schematically showing an electrical configuration of the pretreatment device 10.
Figure 11:
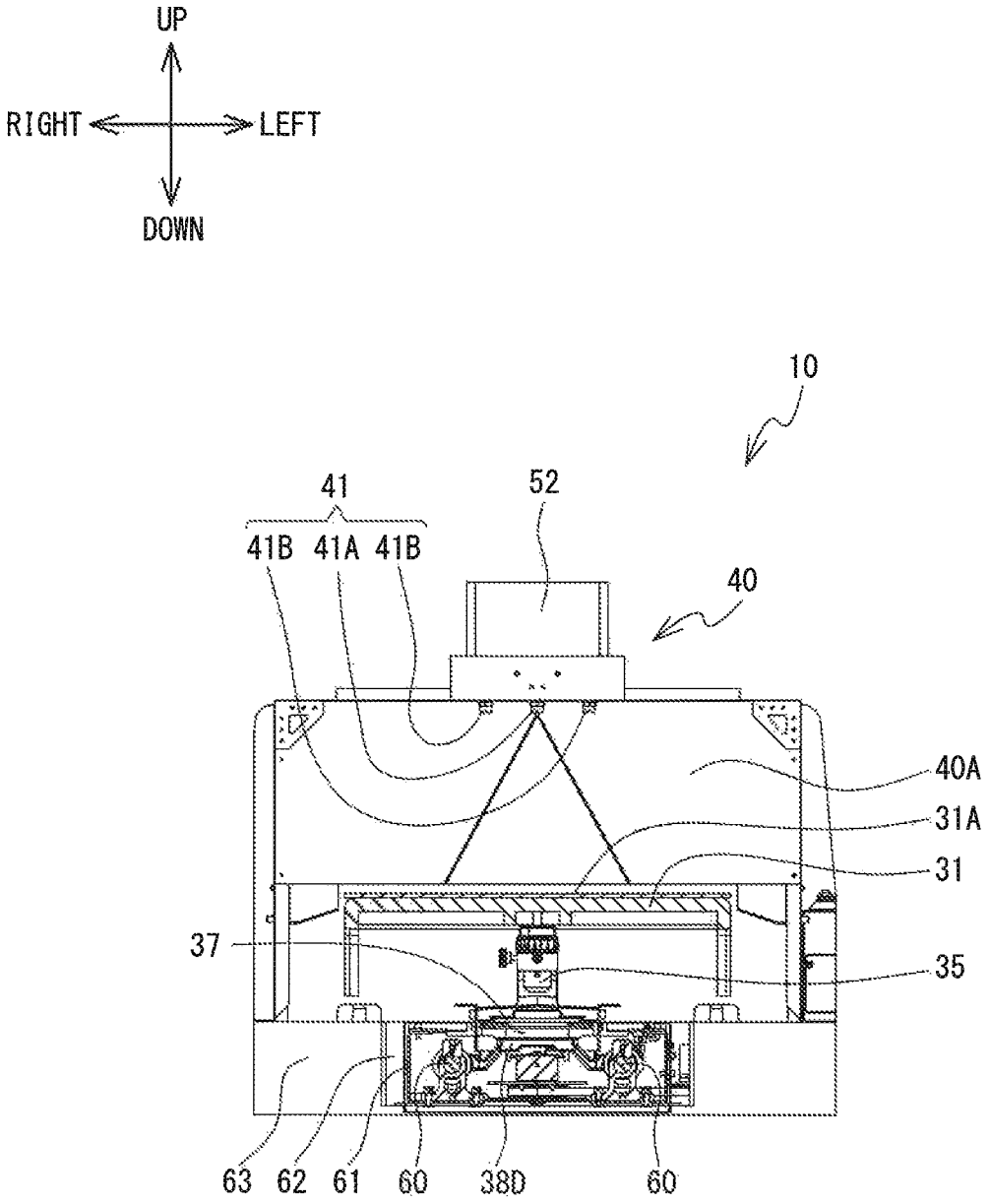
FIG. 11 is a cross-sectional view of the pretreatment device 10 having a plurality of sprays 41.

As shown in FIG. 10, the pretreatment device 10 is provided with the CPU 11, a storage portion 12, a sensor 13, drive circuits 14, 16, and 18, the operation portion 20, a display portion 21, an output/input portion 22, a communication portion 23, and the like, and they are connected with to other via a bus 25. The CPU 11 controls the pretreatment device 10, reads various types of programs from the storage portion 12, and performs various types of operations. For example, the CPU 11 reads a program for main processing from the storage portion 12, and performs the main processing, which will be described in detail below. Further, the CPU 11 functions as a spray control portion, which will be described in detail below, and as a press control portion, which will be described in detail below. The storage portion 12 is provided with a ROM, a RAM, a non-volatile flash memory, and the like. The storage portion 12 stores various types of programs, parameters, and the like. Further, the storage portion 12 stores a first table T1, a second table T2, and operation flags, all of which will be described in detail below. Further, the storage portion 12 stores information associating a number of steps of the platen motor 15 with the application position P2 and the press position P3. Further, the storage portion 12 stores a correlation relationship between the distance between the spraying surface of the spray 41 and the application surface of the cloth, and the spraying amount of the pretreatment agent from the spray 41, such that an application amount of the pretreatment agent per unit area is substantially the same even when the position of the spray 41 changes in the up-down direction.

The sensor 13 is a position detection sensor, such as a transmission sensor, and is disposed at a position at which the set position P1 of the platen 31 can be detected. As long as the sensor 13 can detect the set position P1, a position detection sensor of one of a mechanical type and an optical type can be used. For example, as shown in FIG. 7, the sensor 13 is disposed in the vicinity of one of the guides 60 and on the lower surface of the top plate 61A. Further, the sensor 13 is disposed a position at which the flap 38 is detected by the sensor 13 is disposed to be the position of the set position P1. A first cover 61B is provided so as to cover at least an upper portion of the sensor 13, on the lower surface of the top plate 61A on which the sensor 13 is disposed. The drive circuit 14 is connected to the platen motor 15, and drives the platen motor 15 in accordance with control of the CPU 11. The drive circuit 16 is connected to a spray motor 17 and drives the spray motor 17 in accordance with control of the CPU 11. The drive circuit 18 is connected to the press motor 19 and drives the press motor 19 in accordance with the control of the CPU 11. In the present embodiment, the detector 24 is configured by the combination of the sensor 13 and the platen motor 15. As described above, in the present embodiment, the platen motor 15 is the stepping motor. Thus, since the number of steps of the platen motor 15 is associated with the application position P2 and the press position P3, respectively, and stored, the detector 24 can detect the application position P2 and the press position P3 on the basis of the number of steps from the set position P1.

The operation portion 20 is provided with an operation panel and the like. For example, the operation panel is provided with buttons or the like. Thus, the operator can give a desired instruction to the pretreatment device 10 via the operation portion 20. The display portion 21 is configured by a display device or the like, such as a CRT, a liquid crystal monitor, an organic EL, or the like. The display portion 21 is provided with a touch panel, and also functions as the operation portion 20. The output/input portion 22 is provided with a SD memory card slot, a USB port, and the like.

The communication portion 23 includes at least one of a wireless module or a wired module, and can be connected to a terminal device 30 via a network such as the Internet or an intranet. The pretreatment device 10 need not necessarily include the communication portion 23, and may be connected to the terminal device 30 via the network using the wireless module that can be connected to the USB port. The pretreatment device 10 may be provided with a serial interface of another standard instead of the USB port, and may be connected to an external device, such as the terminal device 30, via a serial cable of the other standard. For example, the terminal device 30 is a PC, a tablet, a smartphone, or the like. The operator can also give a desired instruction to the pretreatment device 10 via the terminal device 30 connected to the pretreatment device 10. In the description below, the instruction of the operator is input to the CPU 11 via the operation portion 20 or the communication portion 23.

First Table T1

The first table T1 is stored in the storage portion 12. In the first table T1, at least one of the temperature or a time period is associated with the position of the spray 41 in the up-down direction. In the present embodiment, as shown in FIG. 12A, the temperature and the time period are associated with the position of the spray 41, and this information is stored in the storage portion 12. For example, the positions of the spray 41 include a first position, which is a position of the spray 41 at a normal time, and a second position, which is a position below the position (first position) of the spray 41 at the normal time. The temperature is the temperature of the press surface 51, and a first temperature is associated with the first position, and a second temperature is associated with the second position. The second temperature may be any temperature, but is a lower temperature than the first temperature, for example. For example, the first temperature is 180 C, and the second temperature is 160 C. The time period is a heat press time period, and a first time period is associated with the first position, and a second time period is associated with the second position. The second time period may be any time period, but is a shorter time period than the first time period, for example. As an example, the first time period is 35 seconds, and the second time period is 15 seconds. The first table T1 is referred to when the CPU 11 (the press control portion) adjusts the temperature of the press surface 51 or the heat press time period. For example, when the position of the spray 41 is set as the first position on the basis of the instruction of the operator, the CPU 11 adjusts the temperature of the press surface 51 to be the first temperature and the heat press time period to be the first time period in accordance with the first table T1. Further, when the position of the spray 41 is set as the second position on the basis of the instruction of the operator, the CPU 11 adjusts the temperature of the press surface 51 to be the second temperature and the heat press time period to be the second time period in accordance with the first table T1. In other words, when the position of the spray 41 is set as the second position on the basis of the instruction of the operator, the heat press operation is performed at the second temperature, which is lower than the first temperature, or the heat press operation is performed for the second time period, which is shorter than the first time period. Note that, when the instruction of the operator includes an instruction relating to the second position and an instruction relating to the first temperature or the first time period, the CPU 11 does not follow the first table T1. In this case, regardless of the instruction relating to the second position, the CPU 11 adjusts the temperature of the press surface 51 to be the first temperature, or adjusts the heat press time period to be the first time period on the basis of the instruction relating to the first temperature or the first time period. Note that, instead of the first table T1, the storage portion 12 may store a function that expresses a relationship between the position of the spray 41 and the temperature, and a function that expresses a relationship between the position of the spray 41 and the heat press time period. Those functions can be obtained through experiments, and the like. In this case, the second position can be set to be variable. Note that, when one of the temperature or the time period is not stored in association with the position of the spray 41 that is stored in the first table T1, it is sufficient that the temperature and the time period that is not stored in association with the position of the spray 41 be respectively fixed to predetermined values.

Second Table T2

The second table T2A will be explained with reference to FIG. 12B and FIG. 12C. As shown in FIG. 12B, the second table T2 shows the temperature of the press surface 51 and the heat press time period for a case in which the instruction of the operator does not include the spray 41 whose spraying is to be stopped. As shown in FIG. 12C, the second table T2 shows the temperature of the press surface 51 and the heat press time period for a case in which the instruction of the operator includes the spray 41 whose spraying is to be stopped. As an example, as shown in FIG. 11, the spray 41 at the center of application portion 40 is referred to as a first spray 41 A, and the left and right sprays 41 of the first spray 41 A are referred to as the second sprays 41 B, respectively. The description will be made below using a case in which all of the sprays 41 perform the spraying, which is a case in which both the first spray 41 A and the second spray 41 B perform the spraying. Further, as a case in which the first spray 41 A performs the spraying and the second spray 41 B does not perform the spraying, the description will be made below using a case in which some of the sprays 41 stop the spraying. In the second table T2, when the operation flag is "1," it indicates that the pretreatment agent is to be sprayed from all of the sprays 41, and when the operation flag is "0," it indicates that the operator has given, to some of the sprays 41, the instruction to stop the spraying. A default value of the operation flag stored in the storage portion 12 is "1," and when the instruction of the operator is for some of the sprays 41 stop the operation, the CPU 11 changes the operation flag from "1" to "0." Thus, the CPU 11 (the press control portion) refers to the value of the operation flag stored in the storage portion 12, and can identify the second table T2 that matches the value of the operation flag. As a result, the CPU 11 can adjust the temperature of the press surface 51 and the heat press time period to be the temperature and the time period of the identified second table T2.

For example, when all of the sprays 41 spray the pretreatment agent, the CPU 11 adjusts the temperature of the press surface 51 to be a third temperature and the heat press time period to be a third time period with reference to the second table T 2 shown in FIG. 12B. Further, when the instruction to stop the spraying has been given to some of the sprays 41, on the basis of the instruction of the operator, the CPU 11 adjusts the temperature of the press surface 51 to be a fourth temperature and the heat press time period to be a fourth time period with reference to the second table T 2 shown in FIG. 12C. In other words, when the operation of some of the sprays 41 is stopped on the basis of the instruction of the operator, the heat press is performed at the third temperature, which is lower than the fourth temperature, or the heat press is performed for the third time period, which is shorter than the fourth time period. Note that, when the instruction of the operator includes the instruction to some of the sprays 41 to stop the spraying, and the instruction relating to the third temperature or the third time period, the CPU 11 does not follow the second table T2. In this case, regardless of the instruction to stop the spraying, the CPU 11 adjusts the temperature of the press surface 51 to be the third temperature, or adjusts the heat press time period to be the third time period on the basis of the instruction relating to the third temperature or the third time period. Note that, instead of the second table T2, the storage portion 12 may store a function that expresses a relationship between the number of the sprays 41 that are instructed to stop the spraying and the temperature, and a function that expresses a relationship between the number of the sprays 41 that are instructed to stop the spraying and the heat press time period. Those functions can be obtained through experiments, and the like.

Main Processing

Figure 13:
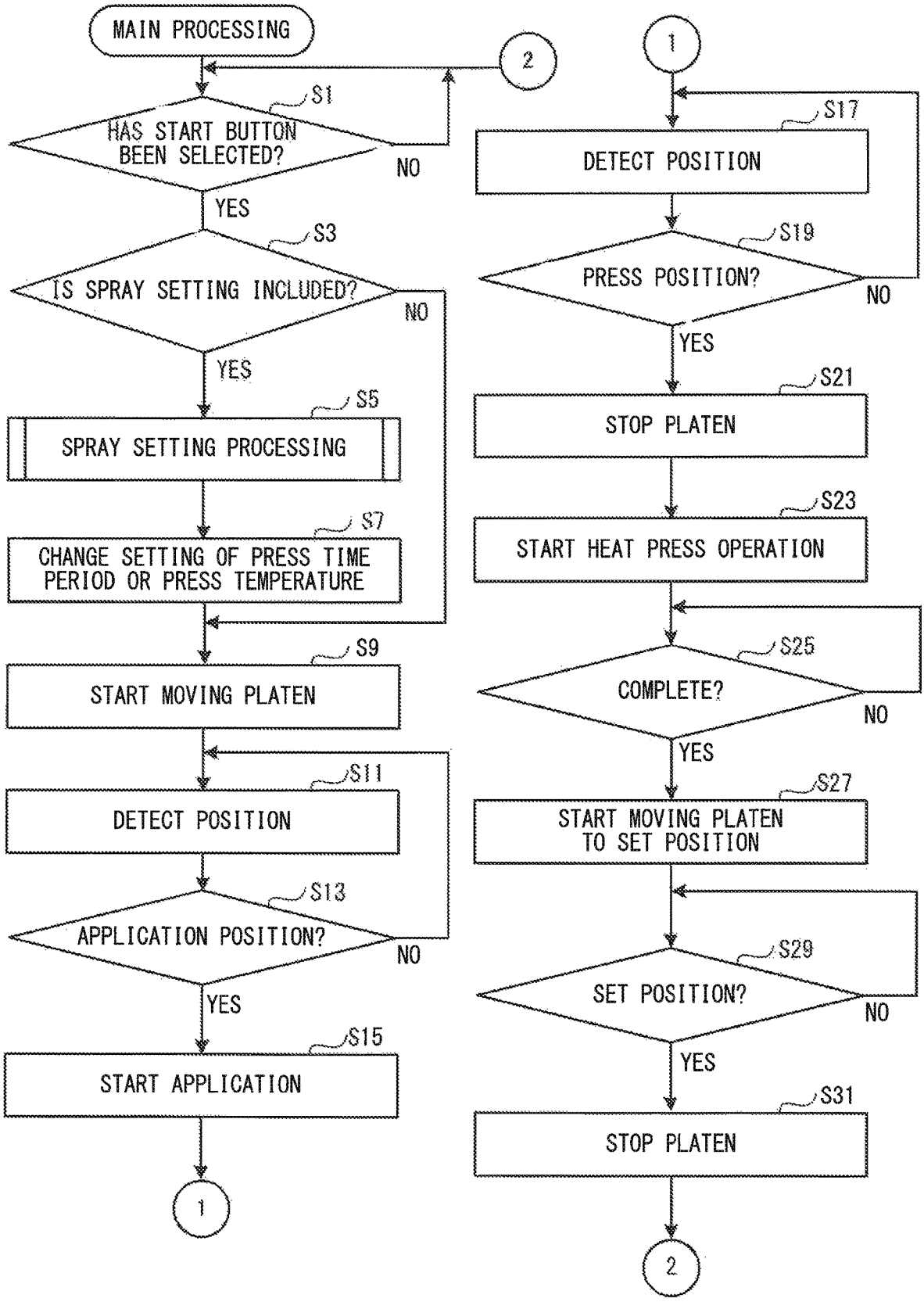
FIG. 13 is a flowchart of main processing.

The main processing will be explained with reference to FIG. 13. The CPU 11 reads the program for the main processing, and performs the main processing. The main processing is started when triggered by turning on a power source, for example.

The CPU 11 determines whether the instruction of the operator includes a selection of a start button (step S1). When it is determined that the selection of the start button is not included (no at step S1), the CPU 11 repeats the processing at step S1, and waits for the selection of the start button. When it is determined that the selection of the start button is included (yes at step S1), the CPU 11 determines whether the instruction of the operator includes a setting of the sprays 41 (step S3). More specifically, the CPU 11 determines whether the instruction of the operator includes at least one of settings relating to a position of the sprays 41 and the stopping of some of the sprays 41, for example.

When it is determined that the setting of the sprays 41 is not included (no at step S3), the CPU 11 advances the processing to step S9. When it is determined that the setting of the sprays 41 is included (yes at step 3), the CPU 11 performs spray setting processing (step S5), which will be described later. Of the heat press time period and the temperature of the press surface 51, the CPU 11 (the press control portion) changes the setting of whichever setting has been changed (step S7). More specifically, as described above, when the instruction of the operator includes a change in the position of the sprays 41, or when the instruction of the operator includes the stopping of some of the sprays 41, the CPU 11 changes the heat press time period or the temperature of the press surface 51 in accordance with the instruction relating to the change of the position or the stopping of the operation. A default period of the heat press time period is the first time period or the third time period, and a default temperature of the temperature of the press surface 51 is the first temperature or the third temperature. The first temperature and the third temperature may be the same, or may be different from each other. Similarly, the first time period and the third time period may be the same, or may be different from each other. Next, the CPU 11 starts the movement of the platen 31 (step S9). Next, the CPU 11 detects the position of the platen 31 on the basis of a signal from the detector 24 (step S11).

The CPU 11 determines whether the position of the platen 31 detected on the basis of the signal from the detector 24 is the application position P2 (step S13). When it is determined that the position of the platen 31 is not the application position P2 (no at step 13), the CPU returns to the processing at step S11 and repeats the above-described processing. When it is determined that the position of the platen 31 is the application position P2 (yes at step 13), the CPU 11 (a spray control portion) controls the application portion 40 and starts applying the pretreatment agent onto the cloth (step S15). In this case, when the position of the spray 41 is positioned at the second position, which is lower than the first position that is the position of the spray 41 at the normal time, it is preferable that the CPU 11 (an spray control portion) performs control such that the application amount per unit area becomes substantially the same as the application amount per unit area at the normal time when the spray 41 is positioned at the first position.

The detector 24 detects the position of the platen 31 (step S17). The CPU 11 determines whether the position of the platen 31 is the press position P3 on the basis of a signal from the detector 24 (step S19). More specifically, the CPU 11 makes the determination by comparing the number of steps of the platen motor 15 from the set position P1 with the number of steps of the press position P3 that is stored in the storage portion 12. When it is determined that the position of the platen 31 is not the press position P3 (no at step S19), the CPU 11 returns to the processing at step S17 and repeats the above-described processing. When it is determined that the position of the platen 31 is the press position P3 (yes at step S19), the CPU 11 stops the platen 31 (step S21). By controlling the heat press portion 50, the CPU 11 lowers the press surface 51 and starts the heat press operation on the cloth placed on the platen 31 (step S23).

The CPU 11 determines whether the heat press operation is complete (step S25). More specifically, when the heat press portion 50 has performed the heat press operation for the set heat press time period, the CPU 11 determines that the heat press operation is complete (yes at step S25). When it is determined that the heat press operation is not complete (no at step S25), the CPU 11 repeats the processing at step S25 and waits for the heat press operation to be complete. When it is determined that the heat press operation is complete (yes at step S25), the CPU 11 starts the movement of the platen 31 to the set position P1 (step S27).

The CPU determines whether the platen 31 has reached the set position P1 on the basis of the signal from the detector 24 (step S29). More specifically, when the sensor 13 detects the flap 38, it is determined that the platen 31 has reached the set position P1 (yes at step S29). When it is determined that the platen 31 has not reached the set position P1 (no at step S29), the CPU 11 repeats the processing at step S29 and waits for the platen 31 to reach the set position P1. When it is determined that the platen 31 has reached the set position P1 (yes at step S29), the CPU 11 stops the platen 31 (step S31) and returns to the processing at step S1.

Spray Setting Processing

Figure 14:
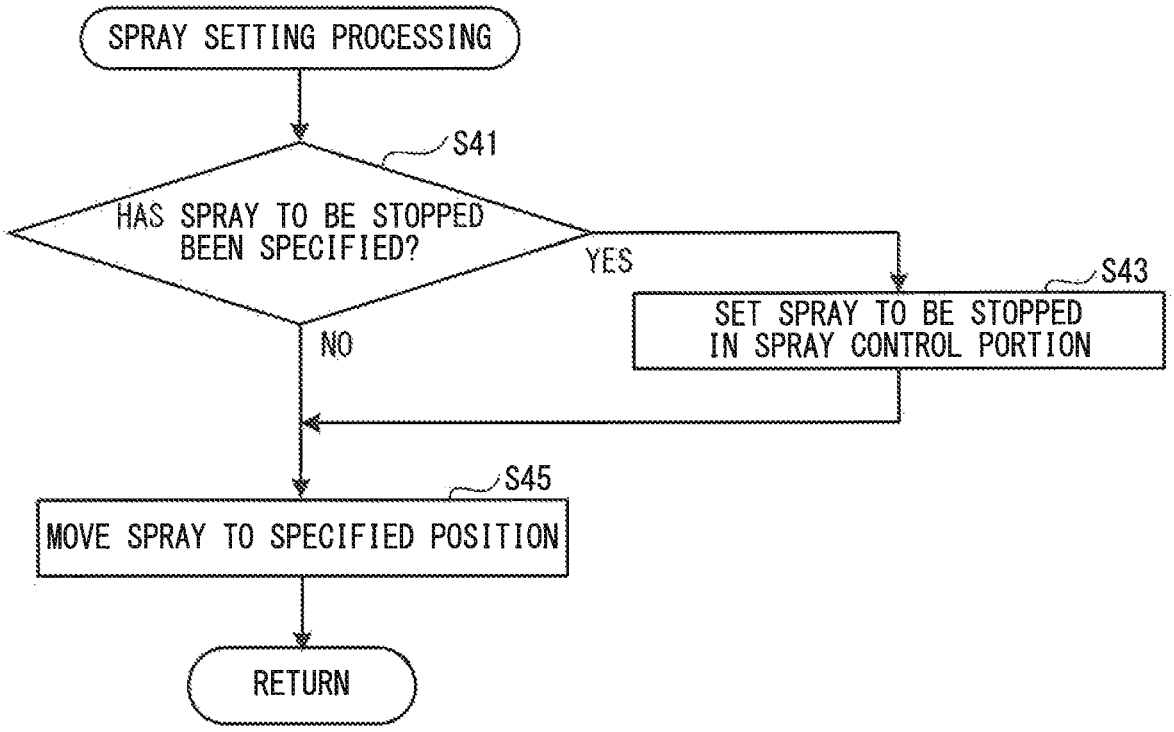
FIG. 14 is a flowchart of spray setting processing.

A flow of the spray setting processing will be explained with reference to FIG. 14. The spray setting processing is processing corresponding to the processing at step S5 of the main processing.

The CPU 11 determines whether the instruction of the operator includes the stopping of some of the sprays 41 (step S41). More specifically, the CPU determines whether the instruction has been given to stop some of the sprays 41 on the basis of the operation flag. When the operation flag is "1," the CPU 11 determines that the instruction has not been given to stop some of the sprays 41 (no at step S41). On the other hand, when the operation flag is "0," the CPU 11 determines that the instruction has been given to stop some of the sprays 41 (yes at step S41). When it is determined that the instruction has been given to stop some of the sprays 41 (yes at step S41), the CPU 11 sets the spray(s) 41 specified by the operator to be stopped, for the spray control portion (step S43). The CPU 11 advances the processing to step S45.

When it is determined that the instruction has not been given to stop some of the sprays 41 (no at step S43), the CPU 11 (the spray control portion) moves the sprays 41 to a specified position (step S45).

Main Operations and Effects

In the pretreatment device 10 of the above-described embodiment, the application portion 40 is disposed at a position separated from the set position in the first direction, and the heat press portion 50 is disposed at a position separated from the application portion 40 in the first direction. In other words, the heat press portion 50 is disposed such that the application portion 40 is sandwiched between the set position P1, at which the operator sets the cloth on the platen 31, and the heat press portion 50. Thus, in the pretreatment device 10 provided with the heat press portion 50, the operator can be distanced from the heat press portion 50 by the distance created as a result of sandwiching the application portion 40. Further, the guides 60 guide the movement of the platen 31 to the press position P3 for which the distance from the set position P1 to the press position P3 is longer than the distance from the set position P1 to the application position P2.

The platen 31 of the above-described embodiment can move in the up-down direction, and is provided with the contact portions 63A that receive the press pressure generated by the heat press by coming into contact with the platen 31 when the platen 31 is heat pressed by the heat press portion 50. Since the contact portions 63A receive the press pressure, the press pressure received by the guides 60 can be reduced. Thus, the rigidity of the guides 60 does not need to be strengthened as much as in the pretreatment device 10 that is not provided with the contact portions 63A. As a result, the pretreatment device 10 of the present embodiment can achieve both cost reductions or downsizing.

In the pretreatment device 10 of the above-described embodiment, the platen 31 is provided with the leg portions 32, and at the time of the heat press operation, the leg portions 32 come into contact with the contact portions 63A. Since the press pressure is received by the leg portions 32 and the contact portions 63 coming into contact with each other at the time of the heat press operation, the press pressure received by the guides 60 can be reduced. Thus, the rigidity of the guides 60 does not need to be strengthened as much as in the pretreatment device 10 that is not provided with the leg portions 32 and the contact portions 63A. As a result, the pretreatment device 10 of the present embodiment can achieve both cost reductions or downsizing.

In the pretreatment device 10 of the above-described embodiment, the number of the leg portions 32 of the platen 31 is four. Thus, when the platen 31 is heat pressed by the heat press portion 50, the platen 31 is supported at three or more points. As a result, a possibility of the platen 31 being tilted can be reduced.

The pretreatment device 10 of the above-described embodiment is provided with the urging member 39 that urges the platen 31 in the upward direction. In other words, since the platen 31 can move in the downward direction, when the application portion 40 applies the pretreatment agent onto the cloth, there is a possibility that the distance between the spray 41 and the cloth may change. Since the platen 31 is always being urged in the upward direction, it is easier to maintain the distance between the cloth and the spray 41 to be constant. Thus, it is possible to reduce a possibility of an application region being displaced as a result of the distance between the spray 41 and the cloth changing. Further, since the platen 31 is urged by the urging member 39 in the upward direction when the platen 31 receives the press pressure, the contact portions 63A can reliably receive the press pressure.

In the pretreatment device 10 of the above-described embodiment, the plate-shaped porous member 31A is placed on the platen 31, and the cloth is placed on the porous member 31A. Further, a height from a support contact surface of the pretreatment device 10 to the cloth is set to be lower than a height of the press surface 51. Thus, even when the porous member 31A is placed on the platen 31 in order to improve the release of the steam resulting from the heat press operation, it is possible to prevent the cloth or the porous member 31A from being caught by the press surface 51 when the platen 31 is moved to the press position P3.

In the pretreatment device 10 of the above-described embodiment, the end portion 31B of the upper surface of the platen 31 or the end portion 51A of the press surface 51 is formed as a curved surface, and one of the upper surface of the platen 31 and the press surface 51 is larger than the other. When the cloth is heat pressed, a press mark is likely to be conspicuous along a boundary between a section of the cloth placed on the platen 31 and a section of the cloth that extends beyond the platen 31. However, the press mark becomes less conspicuous by forming the end portion 31B of the upper surface of the platen 31 or the end portion 51A of the press surface 51 to be the curved surface.

In the pretreatment device 10 of the above-described embodiment, the end portion 31B of the upper surface of the platen 31 is formed to be the tapered portion that is inclined downward (the press direction), or the end portion 51A of the press surface 51 is formed to be the tapered portion that is inclined upward (the opposite direction to the press direction), and one of the upper surface of the platen 31 and the press surface 51 is larger than the other. When the cloth is heat pressed, the press mark is likely to be conspicuous along the boundary between the section of the cloth placed on the platen 31 and the section of the cloth that extends beyond the platen 31. The press mark becomes less conspicuous by forming the end portion 31B of the upper surface of the platen 31 to be the tapered portion that is inclined downward, or by forming the end portion 51A of the press surface 51 to be the tapered portion that is inclined upward.

In the pretreatment device 10 of the above-described embodiment, when the platen 31 is positioned at the press position P3, the press surface 51 is larger than the platen 31 in all directions. Since the press surface 51 is larger than the platen 31 in all directions, when the pretreatment agent is applied to the cloth placed on the entire surface of the platen 31, the pretreatment device 10 can heat press the region to which the pretreatment agent has been applied in a single operation.

The pretreatment device 10 of the above-described embodiment is provided with the detector 24 that detects the position of the platen 31, and the heat press portion 50 moves the press surface 51 in the downward direction only when the detector 24 detects that the platen 31 is at the press position P3. Thus, it is possible to reduce a possibility of the heat press portion 50 performing the heat press operation in a state in which the platen 31 is not at the press position P3.

In the pretreatment device 10 of the above-described embodiment, the detector 24 includes the optical or mechanical sensor 13, and the first cover 61B is provided that is disposed on the upper portion of the sensor 13. Since the first cover 61B is disposed on the upper portion of the sensor 13, it is possible to reduce a possibility of the pretreatment agent applied by the application portion 40 attaching to the sensor 13 and causing the sensing function to deteriorate.

In the pretreatment device 10 of the above-described embodiment, the application portion 40 is housed in the second cover 40A that is provided with the four side surfaces and the upper surface. Since the application portion 40 is housed in the second cover 40A, the pretreatment device 10 can reduce a dispersion range of the pretreatment agent applied by the application portion 40.

The pretreatment device 10 of the above-described embodiment is provided with the spray 41 that can move in the up-down direction, and when the spray 41 is positioned at the first position, the heat press portion 50 performs the heat press for the first time period at the first temperature (no at step S3; step S23 of the main processing). On the other hand, when the spray 41 is positioned at the second position, the pretreatment device 10 performs the heat press either for the second time period, which is shorter than the first time period, or at the second temperature, which is lower than the first temperature (yes at S3; step S5; step S23 of the main processing). Since the spray 41 can move in the up-down direction, the spray 41 can be moved downward in accordance with a size of the application range of the pretreatment agent. When the spray 41 is positioned at the second position, since the application range becomes smaller, in some cases, the application amount of the pretreatment device 10 may be reduced. Thus, the pretreatment device 10 can appropriately perform the heat press by causing the heat press time period to be shorter or the press temperature to be lower.

When the pretreatment device 10 of the above-described embodiment is provided with the plurality of sprays 41 and all of the sprays 41 are caused to spray the pretreatment agent, the heat press portion 50 performs the heat press operation for the third time period at the third temperature (no at S3; step S23 of the main processing). On the other hand, when some of the sprays 41 do not spray the pretreatment agent, the pretreatment device 10 performs the heat press operation either for the fourth time period, which is shorter than the third time period, or at the fourth temperature, which is lower than the third temperature (yes at S3; step S5; step S23 of the main processing). When some of the sprays 41 do not spray the pretreatment agent, the application range is narrow. In this case, the application amount of the pretreatment agent is reduced compared with the case in which all of the sprays 41 are caused to spay the pretreatment agent. Thus, the pretreatment device 10 can appropriately perform the heat press operation by causing the heat press time period to be shorter or the press temperature to be lower.

MODIFIED EXAMPLES

Note that the present invention is not limited to the above-described embodiment, and changes to be described below can be made, for example. In the above-described embodiment, the detector 24 is configured by the combination of the sensor 13 and the platen motor 15. However, the detector 24 may be provided with an encoder and may detect the position of the platen 31 on the basis of a feedback signal (a pulse signal) from the encoder. In this case, the platen motor 15 need not necessarily be the stepping motor.

In the above-described embodiment, the platen 31 includes the four leg portions 32. However, it is sufficient that the platen 31 includes at least one of the leg portions 32. In this case, it is sufficient that the contact portion 63A be disposed at a position facing each of the leg portions 32. Further, the contact portion 63A need not necessarily be provided. In this case, it is sufficient that the length of each of the leg portions 32 in the up-down direction be set such that each of the leg portions 32 can come into contact with the second base 63 at a position that does not exceed the downward movement limit of the platen 31 at the time of the heat press operation. Similarly, the platen 31 need not necessarily be provided with the leg portion 32. In this case, it is sufficient that the height of the contact portion 63A be set such that a back surface of the platen 31 can come into contact with each of the contact portions 63A at a position that does not exceed the downward movement limit of the platen 31 at the time of the heat press operation. The leg portion 32 need not necessarily be disposed at the end portion of the platen 31 as long as a position facing the leg portion 32 is positioned on the upper surface of the second base 63.

Further, the platen 31 may include two of the plate-shaped leg portions 32 that extend in the left-right direction and are disposed at the front end and the rear end of the platen 31, or in the vicinity of each of the front end and the rear end of the platen 31. The platen 32 may further include one or more of the plate-shaped leg portions 32 that extend in the left-right direction as well as the two plate-shaped leg portions 32 that extend in the left-right direction and are disposed at the front end and the rear end of the platen 31, or in the vicinity of each of the front end and the rear end of the platen 31. Further, the platen 31 may include a plurality of leg portions, each having the same shape as the leg portion 32 of the above-described embodiment, at left and right end portions of the back surface of the platen 31 as well as the two plate-shaped leg portions 32 that extend in the left-right direction and are disposed at the front end and the rear end of the platen 31, or in the vicinity of each of the front end and the rear end of the platen 31. In other words, it is sufficient that at least one of the contact portion 63A and the leg portion 32 have a configuration that can support the platen 31 while being disposed at a position that does not exceed the downward movement limit of the platen 31 at the time of the heat press operation.

In the above-described embodiment, the platen 31 moves in the up-down direction. However, the platen 31 may move in the left-right direction, and the platen 31 disposed at the set position P1, the application portion 40, and the heat press portion 50 may be disposed in this order in one of the left to right direction or the right to left direction. In this case, the one of the left to right direction or the right to left direction is the first direction. More specifically, a direction in which the guides 60 extend from a position corresponding to the set position P1 is the first direction. In either of the cases, the heat press portion 50 is disposed at a position further separated from the set position P1 than the application portion 40. Thus, in the same manner, by distancing the heat press portion 50 from the set position P1, it is possible to distance the operator from the heat press portion 50.

In the above-described embodiment, when the spray 41 is positioned at a position lower than at the normal time, the heat press portion 50 performs the heat press operation at the second temperature or for the second time period. In other words, one of the temperature or the time period is changed. However, both the temperature and the time period may be changed. Further, the second temperature and the second time period may be changed in accordance with the position of the spray 41.

In the above-described embodiment, when some of the sprays 41 do not spray the pretreatment agent, the heat press portion 50 performs the heat press operation at the fourth temperature or for the fourth time period. In other words, one of the temperature or the time period is changed. However, both the temperature and the time period may be changed. Further, the fourth temperature and the fourth time period may be changed in accordance with the number of the sprays 41 that do not spray the pretreatment agent.

In the above-described embodiment, the press surface 51 is moved downward to heat press the cloth placed on the platen 31. However, a configuration may be adopted in which a drive mechanism to move the platen 31 in the up-down direction is provided, and the platen 31 may be moved upward so as to come into contact with the press surface 51 when the platen 31 is positioned at the press position P3.

In the above-described embodiment, the sensor 13 is disposed at a position at which the sensor 13 can detect the set position P1. However, the sensor 13 may be disposed at a position at which the sensor 13 can detect at least one of the set position P1, the application position P2, or the press position P3. In this case, as described above, it is preferable that the first cover 61B be disposed on the upper portion of the sensor 13. As described above, this is because it is possible to reduce the possibility of the sensing function deteriorating as a result of the pretreatment agent applied by the application portion 40 attaching to the sensor 13.

Figure 15:
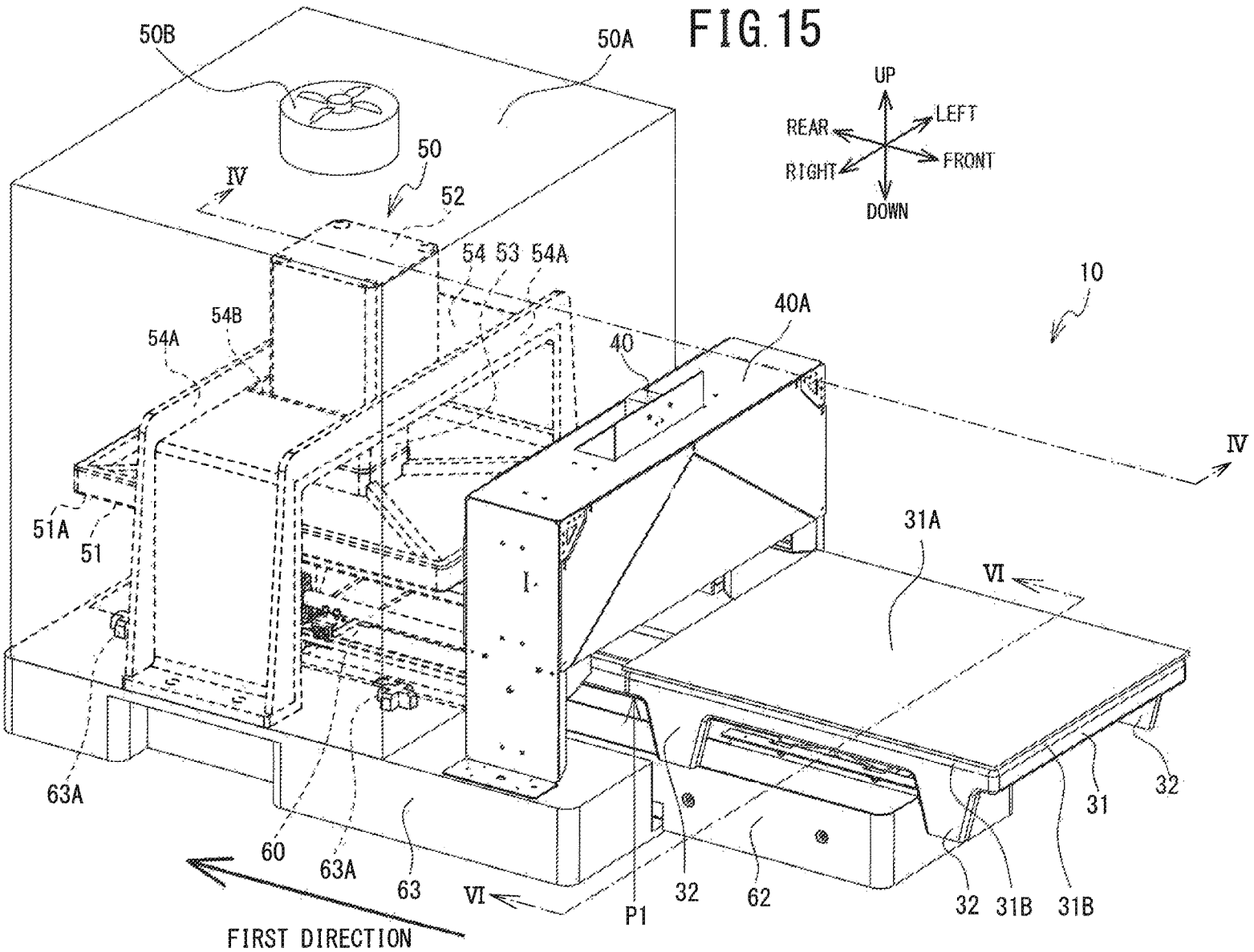
FIG. 15 is a perspective view showing an configuration of a modified examples of the pretreatment device 10.

In the above-described embodiment, the heat press portion 50 is not surrounded by a cover. However, as shown in FIG. 15, a third cover 50A may be provided that does not surround at least an upper portion of the heat press portion 50. Since at least the upper portion of the heat press portion 50 is not surrounded, the steam generated by the heat press operation can be discharged from an opening positioned in an upper portion of the third cover 50A. Further, a third cover 50A may be provided that is provided with four side surfaces facing the upper, lower, left, and right directions, and an upper surface, and a ventilation fan 50B may be provided in a central section of the upper surface of the third cover 50A. By the ventilation fan 50B being provided, even when the heat press portion 50 is surrounded except for a lower portion thereof, the pretreatment device 10 can discharge the steam generated by the heat press operation to the outside using the ventilation fan 50B. Further, by disposing the ventilation fan 50B at a position facing a central section of the press surface 51, the pretreatment device 10 can efficiently discharge the steam to the outside.

In the above-described embodiment, the first temperature is 180 C, and the second temperature is 160 C. The first time period is 35 seconds, and the second time period is 15 seconds. However, as long as the second temperature is lower than the first temperature and the second time period is shorter than the first time period, those temperatures and time periods may be other temperatures and time periods.

In the above-described embodiment, as an example of an "operation mode," the press surface 51 is lowered by the press surface drive mechanism 52 only when the detector 24 detects the movement of the platen 31 to the press position P3. However, in addition to this "operation mode," a "maintenance mode" may be provided in which the press surface 51 is lowered by the press surface drive mechanism 52 even when the detector 24 has not detected the movement of the platen 31 to the press position P3. The maintenance mode may be a mode for checking whether each of the drive mechanisms is appropriately driven at predetermined timings and the like, for example. By the maintenance mode being provided, a malfunction or a failure of the drive mechanism can be ascertained at an earlier stage.

The programs and the like to perform the main processing may be stored in a disk device or the like provided in a server device on the Internet, and the pretreatment device 10 may download various types of the programs, for example.

According to the embodiment or the modified examples, the pretreatment device 10 may use other types of storage device other than a ROM and a RAM. For example, the pretreatment device 10 may include a storage device, such as a CAM, a SRAM, an SDRAM or the like.

According to the embodiment or the modified examples, the electrical configuration of the pretreatment device 10 may be different from the configuration shown in FIG. 10. Other hardware having a standard/type other than that illustrated in FIG. 10 may be applied to the pretreatment device 10.

For example, the control portion of the pretreatment device 10 shown in FIG. 10 may be configured by a hardware circuit. More specifically, instead of the CPU 11, the control portion may be configured by a reconfigurable circuit such as a FPGA, an ASIC, or the like. The control portion may be configured by both the CPU 11 and the hardware circuit.

In the present embodiment, the application position P2 is in the rear direction that is the first direction with respect to the set position P1, and the press position P3 is in the rear direction that is the first direction with respect to the application position P2. In other words, the guides 60 guide the movement of the platen 31 to the press position P3 for which the distance from the set position P1 to the press position P3 is longer than the distance from the set position P1 to the application position P2. However, for example, the application P2 may be in the left-right direction with respect to the set position P1 and the press position P3 may be in the rear direction with respect to the application position P2. In this case also, the guides 60 guide the movement of the platen 31 to the press position P3 for which the distance from the set position P1 to the press position P3 is longer than the distance from the set position P1 to the application position P2.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A pretreatment device comprising:

a platen;

an application portion configured to apply a pretreatment agent onto a recording medium set on the platen, wherein the application portion includes a spray that is configured to spray the pretreatment agent and that is provided so as to be movable in the press direction;

a heat press portion configured to perform a heat press operation on the recording medium, to which the pretreatment agent has been applied by the application portion, wherein the heat press portion performs processes including:

performing the heat press operation using a first time period and a first temperature when the spray is positioned at a first position, and performing the heat press operation using one of a second time period that is shorter than the first time period and a second temperature that is lower than the first temperature when the spray is positioned at a second position positioned further in the press direction than the first position; and a guide configured to guide a movement of the platen from a set position at which the recording medium is set on the platen to a press position at which the heat press portion performs the heat press operation on the recording medium via an application position at which the application portion applies the pretreatment agent onto the recording medium set on the platen, a distance between the set position and the press position being longer than a distance between the set position and the application position.

2. The pretreatment device according to claim 1, wherein the guide guides the platen to the application position separated in a first direction from the set position, and guides the platen to the press position that is separated in the first direction from the application position.

3. The pretreatment device according to claim 1 further comprising:

a press pressure receiving portion configured to receive a press pressure by the heat press portion coming into contact with the platen when the platen is heat pressed by the heat press portion, wherein the platen is movable with respect to the guide in a press direction of the heat press portion.

4. The pretreatment device according to claim 3, wherein the press pressure receiving portion is provided on the platen and comes into contact with a leg extending in the press direction.

5. The pretreatment device according to claim 4, wherein the platen is provided with at least three of the legs.

6. The pretreatment device according to claim 3, further comprising:

an urging member configured to urge the platen in an opposite direction to the press direction.

7. The pretreatment device according to claim 1, further comprising:

a porous member placed on the platen and configured to support the recording medium, wherein the porous member is positioned further in a press direction than a pre-press position of a press surface of the heat press portion.

8. The pretreatment device according to claim 1, wherein at least one of an end portion of the heat press portion-side surface of the platen and an end portion of the press surface of the heat press portion includes a curved surface, and one of the heat press portion-side surface of the platen and the press surface is larger than the other.

9. The pretreatment device according to claim 1, wherein at least one of an end portion of the heat press portion-side surface of the platen includes a tapered portion that is inclined in a press direction and an end portion of a press surface of the heat press portion includes a tapered portion that is inclined in an opposite direction to the press direction, and one of the heat press portion-side surface of the platen and the press surface of the heat press portion is larger than the other.

10. The pretreatment device according to claim 1, wherein the heat press portion-side surface of the platen is smaller than the press surface of the heat press portion.

11. The pretreatment device according to claim 1, further comprising:

a detector configured to detect whether the platen is disposed at the press position, wherein the heat press portion is movable in a press direction only when the detector detects that the platen is disposed at the press position.

12. The pretreatment device according to claim 11, wherein the detector includes:

one of an optical and a mechanical sensor disposed at the press position; and a first cover disposed at least on an upper portion of the sensor.

13. The pretreatment device according to claim 1, wherein the application portion is housed in a second cover.

14. The pretreatment device according to claim 1, wherein at least an upper portion of the heat press portion is open.

15. The pretreatment device according to claim 1, wherein the heat press portion is housed in a third cover, and the third cover is provided with a ventilation fan.

16. The pretreatment device according to claim 1, wherein the application portion includes a first spray and a second spray configured to spray the pretreatment agent, and the heat press portion performs processes including:

performing the heat press operation using a third time period and a third temperature when the first spray performs spraying and the second spray performs spraying, and performing the heat press operation using one of a fourth time period that is shorter than the third time period and a fourth temperature that is lower than the third temperature when the first spray performs the spraying and the second spray does not perform the spraying.

* * * * *